US006293641B1

(12) United States Patent
Yoshimura et al.

(10) Patent No.: US 6,293,641 B1
(45) Date of Patent: Sep. 25, 2001

(54) RECORDING APPARATUS FOR PERIODICALLY EMITTING RECORDING MATERIALS BY MATERIAL SPECIFIC EMISSION AMOUNT

(75) Inventors: Hisashi Yoshimura, Nara; Norihiro Ochi, Yamatokoriyama, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/090,901

(22) Filed: Jun. 5, 1998

(30) Foreign Application Priority Data

Jun. 6, 1997 (JP) ..... 9-148911

(51) Int. Cl.[7] ..... B41J 29/38; B41J 29/393; B41J 2/165; B41J 2/21

(52) U.S. Cl. ..... 347/14; 347/30; 347/43; 347/33; 347/35; 347/19

(58) Field of Search ..... 347/14, 19, 23, 347/7, 30, 43, 33, 35

(56) References Cited

U.S. PATENT DOCUMENTS 4,593,292 * 6/1986 Lewis ..... 347/7
4,791,435 * 12/1988 Smith et al. ..... 347/35
5,036,337 * 7/1991 Rezanka ..... 347/14
5,331,340 * 7/1994 Sukigara ..... 347/14
5,402,164 * 3/1995 Mutoh ..... 347/19
5,469,196 * 11/1995 Okazaki et al. ..... 347/19
5,552,810 * 9/1996 Matsuo ..... 347/19
5,798,773 * 8/1998 Hiramatsu et al. ..... 347/19

FOREIGN PATENT DOCUMENTS 357 001 771 * 1/1982 (JP) ..... 347/33
A59-7053 1/1984 (JP) .
A62-116153 5/1987 (JP) .
A63-260450 10/1988 (JP) .

* cited by examiner

*Primary Examiner*—Thinh Nguyen
*Assistant Examiner*—Charles W. Stewart, Jr.

(57) ABSTRACT

A recording apparatus capable of printing with high resolution and high precision at high speed while preventing drying of the ink jet head includes an ink jet head for emitting a plurality of types of inks one by one while performing reciprocating operation, an ink receiving equipment provided outside a recording area for receiving the inks emitted from the ink jet head, an ink emission amount setting unit for each ink, for setting the amount of emission of the ink emitted to the ink receiving equipment, and a control unit for controlling the ink jet head such that the ink of the emission amount is periodically emitted to the ink receiving equipment.

32 Claims, 31 Drawing Sheets

RECORDING APPARATUS FOR PERIODICALLY EMITTING RECORDING MATERIALS BY MATERIAL SPECIFIC EMISSION AMOUNT

BACKGROUND OF THE INVENTION

1. Field of the Invention

The present invention relates to a recording apparatus for printing at high speed by emitting ink onto a cloth to be recorded. More specifically, the present invention relates to a recording apparatus capable of high speed printing and not wasting ink in which drying of an ink jet head is prevented even when inks of different properties are used.

2. Description of the Background Art

Methods of industrial textile printing for dying cloth include screen printing, roller printing and transfer printing. Each of these printing methods is a printing technique completed by organic combination of a series of steps including planning of design pattern, engraving or processing of the design pattern, production of starch and preparation of cloth. Such printing technique requires four steps as well as high skill. Therefore, printing of a cloth requires time and labor, and therefore, considerable cost. Further, such printing methods are not necessarily suitable for producing various different types of products in small amount.

Recently, ink jet printing method, which is considered suitable for producing various types of products in small amount has been practically used. Ink jet printing method includes a method of printing using inks of four colors, that is, yellow (Y), magenta (M), cyan (C) and black (B) as in a printer for a personal computer, a method using eight colors including red (R), green (G), blue (B) and a special color in addition to Y, M, C and B, and a method using a total of ten colors.

Further, in order to attain realer printing, density of printing ink is changed in accordance with the design to be printed, so that various tones are realized.

Generally, in a nozzle of a head which is not frequently used, ink dries in the ink emission hole and the vicinity thereof, so that the ink comes to have higher viscosity. This leads to the problems of failure in ink emission or in stability of the direction of ink emission. As already described, when wider variety of inks are used, frequency of use per unit time of each type of ink is reduced, making the problem more serious.

In order to prevent ink viscosity from being increased, Japanese Patent Laying-Open No. 59-7053 discloses an ink jet recording apparatus in which ink of which viscosity has been increased is emitted to an ink receiving equipment at a portion other than the printing portion, at the time of power on. This smoothes subsequent ink emission, ensuring satisfactory printing.

Japanese Patent Laying-Open No. 62-116153 discloses a recording apparatus in which whether ink is to be emitted or not is determined dependent on atmospheric moisture, and when the moisture is lower than a prescribed value, ink is emitted. This prevents increase in ink viscosity.

In an ink jet recording apparatus disclosed in Japanese Patent Laying-Open No. 63-260450, ink emission control is performed dependent on moisture and temperature of the atmosphere. This prevents increase in ink viscosity.

However, in any of the above described three apparatuses, a head is moved to the ink receiving equipment, stopped there and ink is emitted at a time point when it is determined that intermission is necessary. Therefore, much time is consumed for ink emission. Further, inks of all types are emitted simultaneously. This results in increased size of the ink receiving equipment. Further, inks are wasted, as inks of which viscosity are not increased are simultaneously emitted.

Further, a mechanism for preventing overflow of ink from the ink receiving equipment is also important.

SUMMARY OF THE INVENTION

The prevent invention was made to solve the above described problems and its object is to provide a recording apparatus capable of printing with high resolution and high precision at high speed, by preventing drying of the ink jet head.

Another object of the present invention is to provide a recording apparatus capable of printing with high resolution and high precision at high speed by preventing drying of the ink jet head with small amount of ink emission.

An additional object of the present invention is to provide a recording apparatus capable of printing with high resolution and high precision at high speed, while preventing drying of the ink jet head and overflow of discharged ink from an ink receiving equipment.

A further object of the present invention is to provide a recording apparatus capable of printing with high resolution and high precision at high speed by preventing drying of the ink jet head even when atmospheric temperature changes.

The recording apparatus in accordance with an aspect of the present invention includes an ink jet head for emitting a plurality of different types of inks independently while performing a reciprocating operation; an ink receiving equipment provided outside a recording area, for receiving the inks emitted from the ink jet head; an ink emission amount setting unit for setting, for each ink, the amount of emission of the ink to be emitted to the ink receiving equipment; and a control unit for controlling the ink jet head such that the ink of the set emission amount is periodically emitted to the ink receiving equipment.

The ink jet head emits inks to the ink receiving equipment periodically, by the amount determined for each ink. Therefore, drying of the ink jet head can be prevented without consuming much time. Even when a plurality of inks of different properties are used, it is possible to set optimal amount of emission for each ink, and therefore printing with high resolution and high precision is possible.

Preferably, the control unit includes a circuitry for controlling the ink jet head such that the ink of the aforementioned emission amount is emitted to the ink receiving equipment at every reciprocating operation of the ink jet head.

The ink jet head emits inks by the amount determined for each ink, at every reciprocating operation, to the ink receiving equipment. Accordingly, drying of the ink jet head can be prevented without consuming much time. Further, only a small amount of ink need be emitted for one reciprocating operation. Further, it becomes unnecessary to provide ink receiving equipments at opposing ends of the recording apparatus.

More preferably, the ink receiving equipment includes an ink tank provided outside the aforementioned recording area for receiving the inks emitted from the ink jet head, and a sensor for detecting whether the inks received by the ink tank reached a prescribed amount or not.

Since the ink receiving equipment has a detecting unit for detecting whether the received inks reached a prescribed amount or not, it is possible to prevent overflow of the discharged ink from the ink receiving equipment.

The recording apparatus in accordance with another aspect of the present invention includes an ink jet head for emitting a plurality of different types of inks independently while performing a reciprocating operation; an ink receiving equipment provided outside a recording area for receiving the inks emitted from the ink jet head; a prescribed emission amount setting unit for setting a prescribed amount of emission for each ink; a circuitry for measuring the amount of emission of the inks emitted to the recording area by the ink jet head for each ink; and a control unit for controlling the ink jet head such that inks are periodically emitted to the ink receiving equipment by the amount determined for each ink.

The ink jet head emits to the ink receiving equipment the ink of which amount of emission has not yet reached the prescribed amount of emission. Therefore, drying of the ink jet head can be prevented without consuming much time, and ink is not wasted. Even when a plurality of inks of different properties are used, it is possible to set optimal amount of emission for each ink, and therefore printing with high resolution and high precision is possible.

Preferably, the recording apparatus further includes a circuitry for measuring temperature of the ink jet head, and the prescribed emission amount setting unit includes a circuitry for setting the aforementioned prescribed amount of emission determined dependent on the temperature of the ink jet head, for each ink.

The prescribed emission amount setting unit changes the prescribed amount of emission dependent on the temperature of the ink jet head. Therefore, it is not affected by variation in the speed of evaporation of the ink caused by change in atmospheric temperature. Therefore, wasteful ink emission can be prevented and drying of the ink jet head can be prevented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
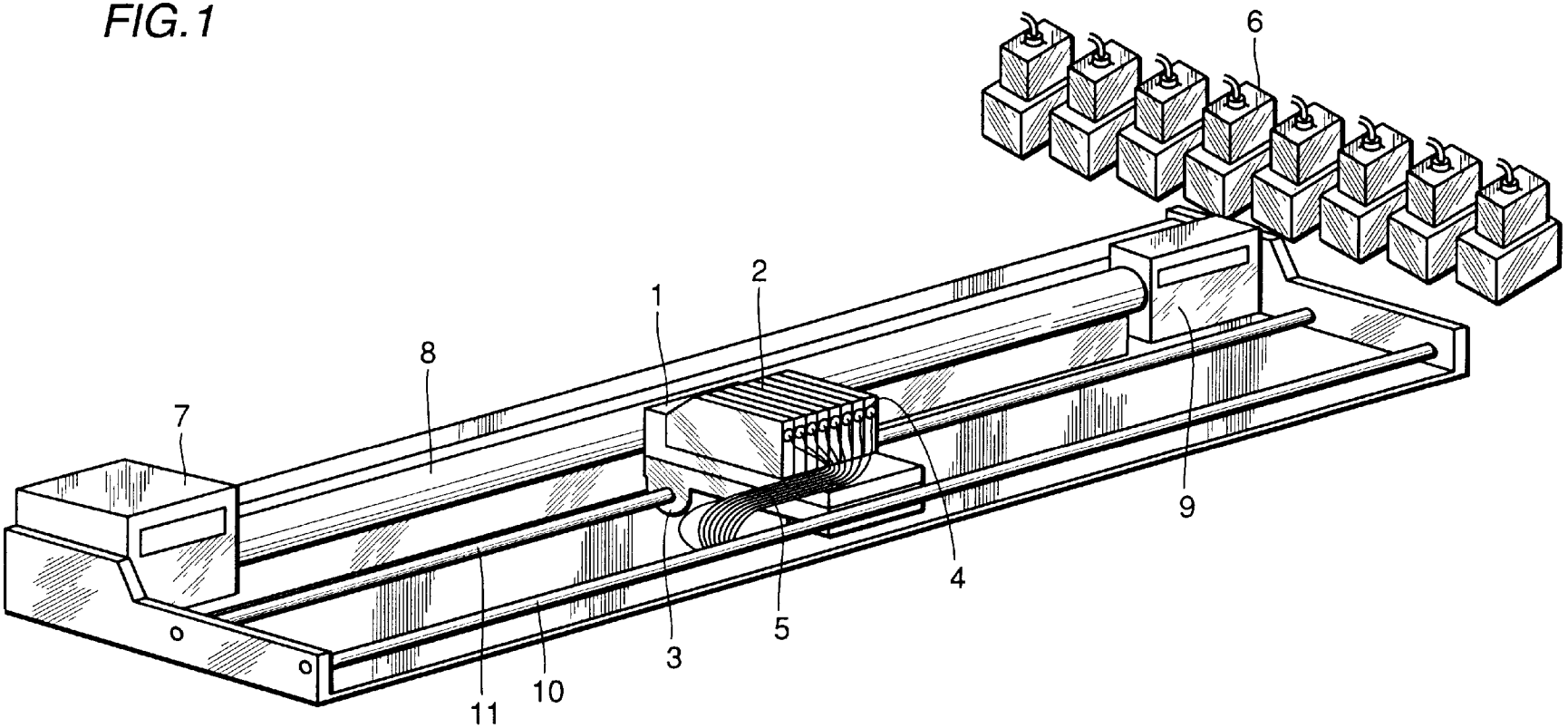
FIG. 1 shows a basic structure of a printer for textile printing in accordance with a first embodiment.
Figure 2:
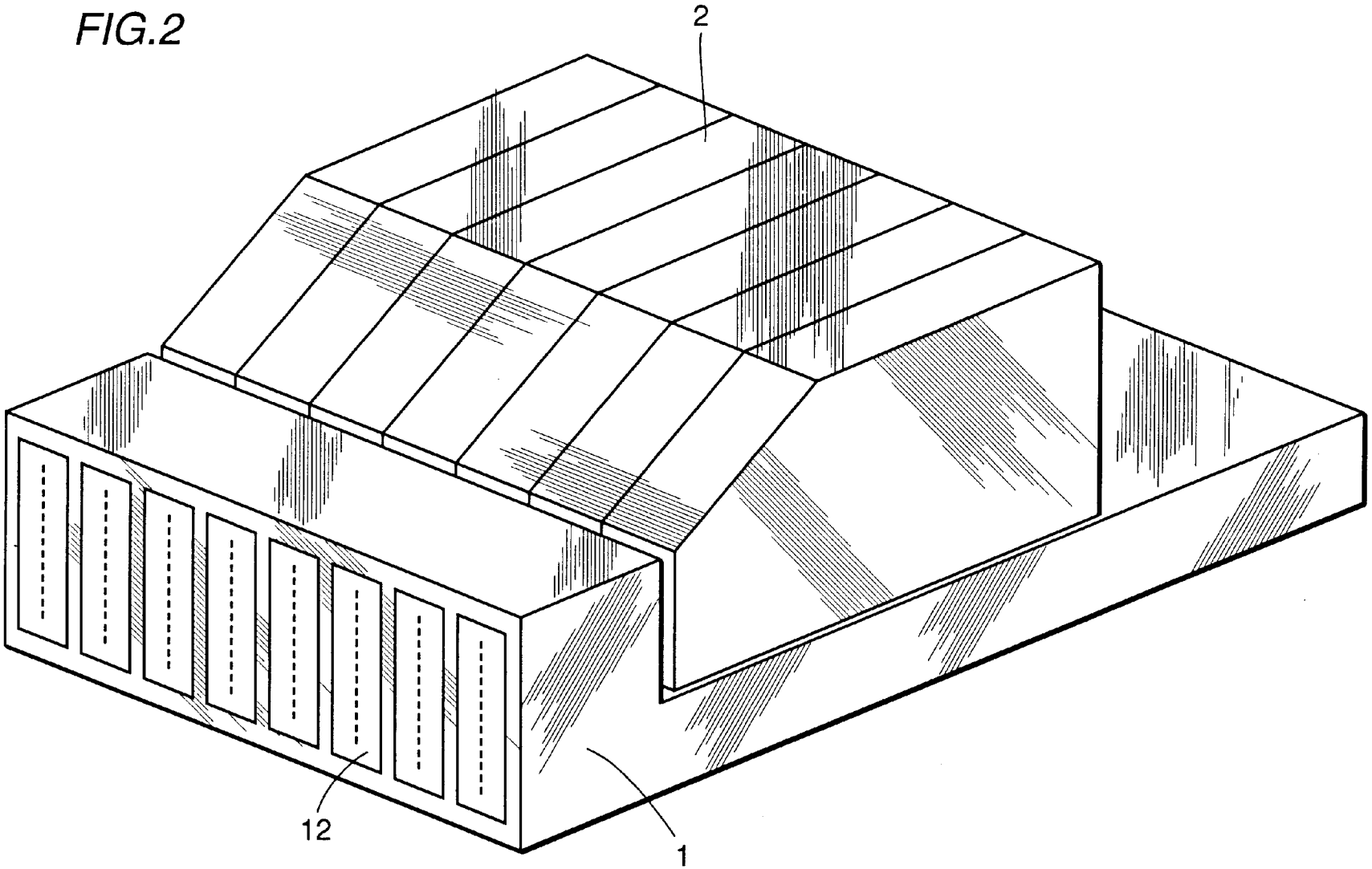
FIG. 2 is an enlarged view of a head portion of the printer for textile printing in accordance with the first embodiment.

Referring to FIGS. 1 and 2, the printer for textile printing in accordance with the present invention includes a platen 8, a first carriage feed shaft 10, a second carriage feed shaft 11, a carriage 3 moving in lateral direction guided by the first and second carriage feed shafts 10 and 11, a head body 1 mounted on carriage 3 and having ink subtanks 2 for 8 colors and nozzles 12 for emitting inks on its front surface, ink tanks 6 for 8 colors, ink supply pipes 5 for guiding ink of each color from ink tanks 6 to ink subtanks 2, a maintenance station 7 for the ink jet head provided at one end of platen 8, and an ink receiving equipment 9 provided at the other end of platen 8, which is outside the printing area, for receiving and reserving inks emitted for preventing drying of nozzles 12.

Ink is supplied to ink subtank 2 through an ink supply inlet 4.

Nozzle 12 opposes to platen 8. The ink supplied from ink subtank 2 is emitted from nozzle 12 to a recording medium fed in tight contact with platen 8, and a pattern is formed on the printing medium.

Figure 3A:
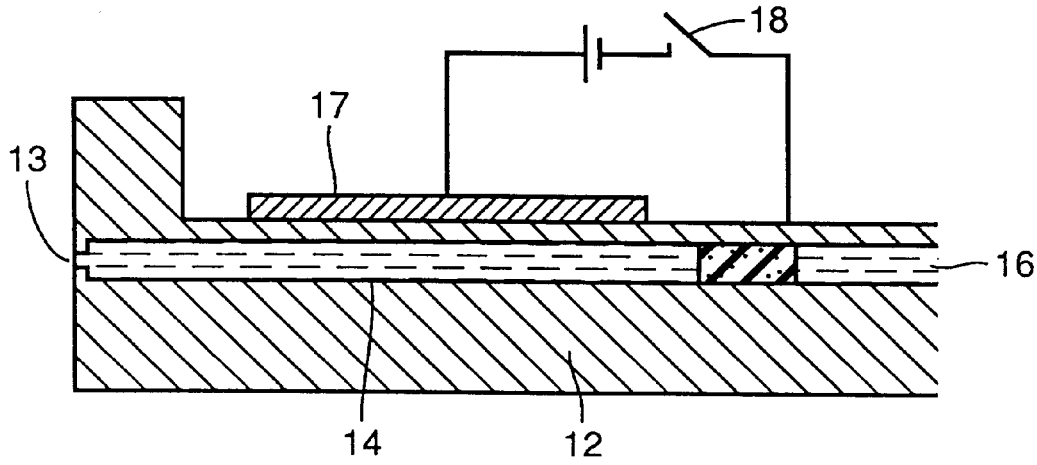
FIG. 3A shows principal of ink emission when the head is not in operation.
Figure 3B:
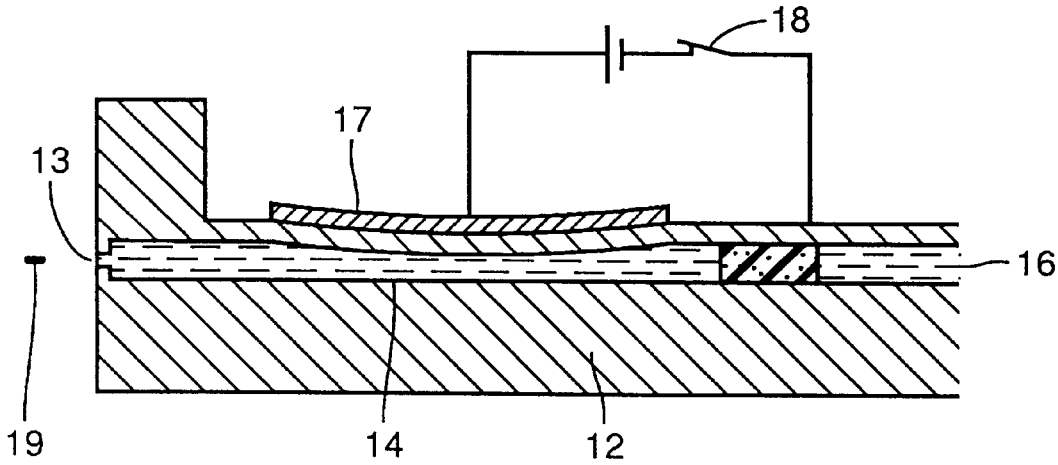
FIG. 3B shows the principal of ink emission when the head is in operation.

Referring to FIGS. 3A to 3B, the principle of ink emission by the ink jet head provided in head body 1 will be described. Generally, in the normal state, ink is in a stationary state, filled in nozzle 12 by capillary action, as shown in FIG. 3A. A piezo oscillator 17 is provided opposing to an ink pressure chamber 14. When a switch 18 formed electronically, for example, is closed and a voltage is applied to piezo oscillator 17, one side of piezo oscillator 17 is contracted as shown in FIG. 3B. Accordingly, piezo oscillator 17 is deflected to the side of ink pressure chamber 14 to reduce volume of ink pressure chamber 14, so that a pressure is generated in ink pressure chamber 14. By this pressure, ink 19 is emitted from orifice 13. When switch 18 is opened and application of the voltage is stopped, volume of ink pressure chamber 14 increases, ink corresponding to the increase volume is supplied from common ink supply path 16, and the state of FIG. 3A is resumed. By repeating such operation, desired patterns are printed on the recording medium.

Figure 4:
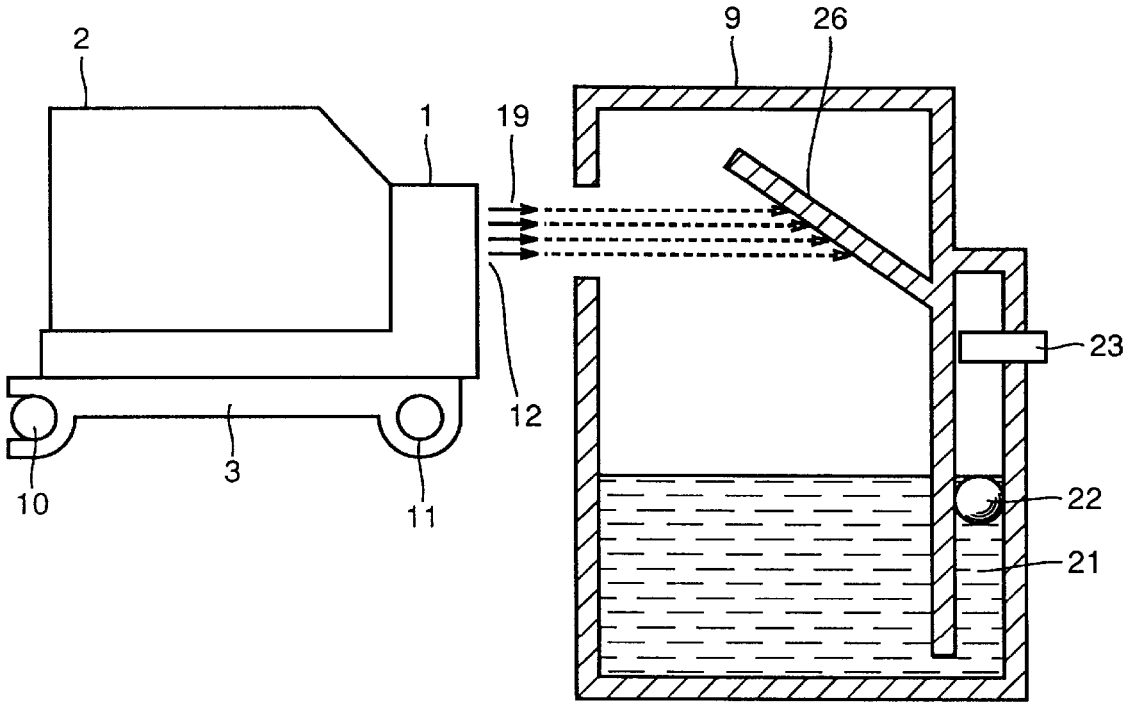
FIG. 4 shows a structure of the ink receiving equipment in accordance with the first embodiment.

Referring to FIG. 4, in ink receiving equipment 9, a sensing float 22 is provided, floating on discharged ink 21. At a prescribed height position, a sensor 23 for detecting float 22 is provided. In ink receiving equipment 9, a receiving plate 26 for receiving the ink emitted from nozzle 12 is further provided.

Head body 1 and ink subtanks 2 mounted on carriage 3 reach a position opposing to ink receiving equipment 9, guided by the first and second carriage feed shafts 10 and 11. Thereafter, ink 19 is emitted from each nozzle 12 to ink receiving equipment 9. As the amount of discharge ink 21 increases, sensing float 22 rises and when sensor 23 detects the float, that is, when the sensor detects that the amount of discharged ink 21 reach a prescribed amount, the printer is stopped after a prescribed operation.

For effective detection of the level of discharged ink 21, it is preferred that the sensing float 22 is formed to have specific gravity of at most 0.95. Further, in order to receive ink without generating any ink mist in ink receiving equipment 9, it is preferred that receiving plate 26 is formed at an angle of at most 30° with respect to the direction of travel. Since the tank for reserving ink is positioned below receiving plate 26, the ink which has reached the receiving plate 26 falls freely and is reserved in the ink tank.

Figure 5:
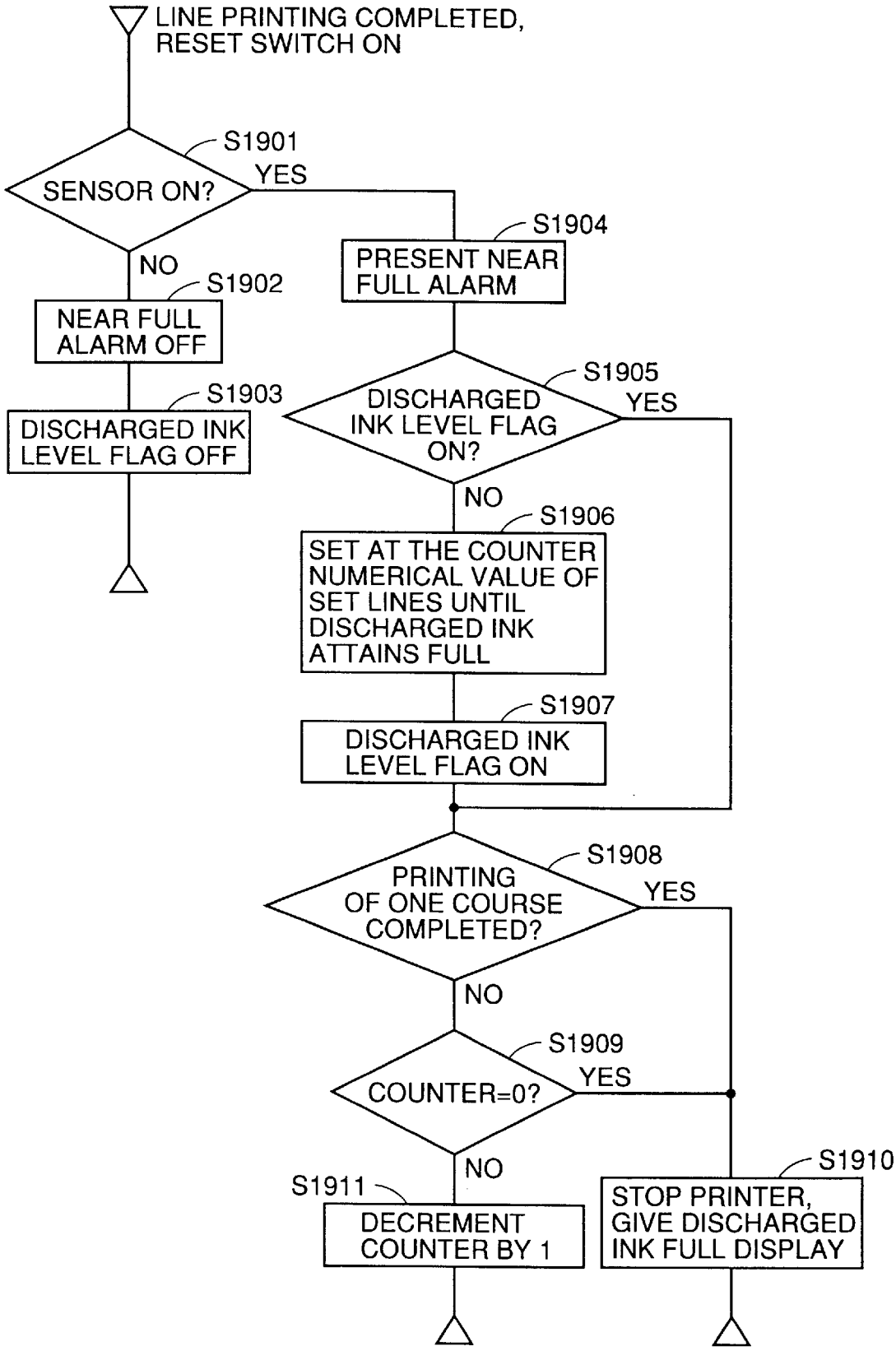
FIG. 5 is a flow chart showing control of the ink receiving equipment of FIG. 4.

Referring to FIG. 5, flow of control related to discharged ink 21 will be described.

The control starts immediately after printing of data corresponding to one line, or starts when a reset switch is turned on, and whether sensor 23 is ON or not is determined (S1901). If sensor 23 is OFF (NO in S1901), it means that the amount of discharged ink 21 is at a low level. Therefore, an alarm of "near full" (the ink receiving equipment 9 is almost full) is not given (S1902), and a flag of discharged ink level is kept OFF (S1903).

If sensor 23 is ON (YES in S1901), it means that the level of discharged ink 23 is high, and an alarm of near full is given (S1904). Whether the flag of discharged ink level is ON or not is determined (S1905). If the discharged ink level flag is OFF (NO in S1905), the number of lines printed until discharged ink 21 attains to the full level is set in a counter (not shown) (S1906), and the discharged ink level flag is set to ON (S1907). Thereafter, the process of S1908, which will be described later, is performed. If the discharged ink level flag is ON (YES in S1905), whether printing of one course is terminated or not is determined in S1908. When printing of one course is completed (YES in S1908), a display is given indicating that the discharged ink 21 is at the full level, and the printer is stopped (S1910). After the printer is stopped, the discharged ink is discarded. Here, one course represents a prescribed number of lines, or a prescribed time period.

When printing of one course is not completed (NO in S1908), whether the counter, at which the number of lines to be printed is set, is 0 or not is determined (S1909). If the counter is 0 (YES in S1909), the flow proceeds to S1910, and the control is terminated. When counter is not zero (NO in S1909), it means that there is a margin until the ink reaches the full level. Therefore, counter is decremented by 1 (S1911), and the control waits for printing of the next data.

By the flow of control described above, the printer apparatus is not stopped amid printing, even when sensor 23 turns ON. Therefore, generation of a line pattern caused by the printer stopping amid the printing operation can be prevented. The line pattern generation is effectively prevented as the printer operation is stopped with a delay of at least one course after turning ON of sensor 23.

Figure 6:
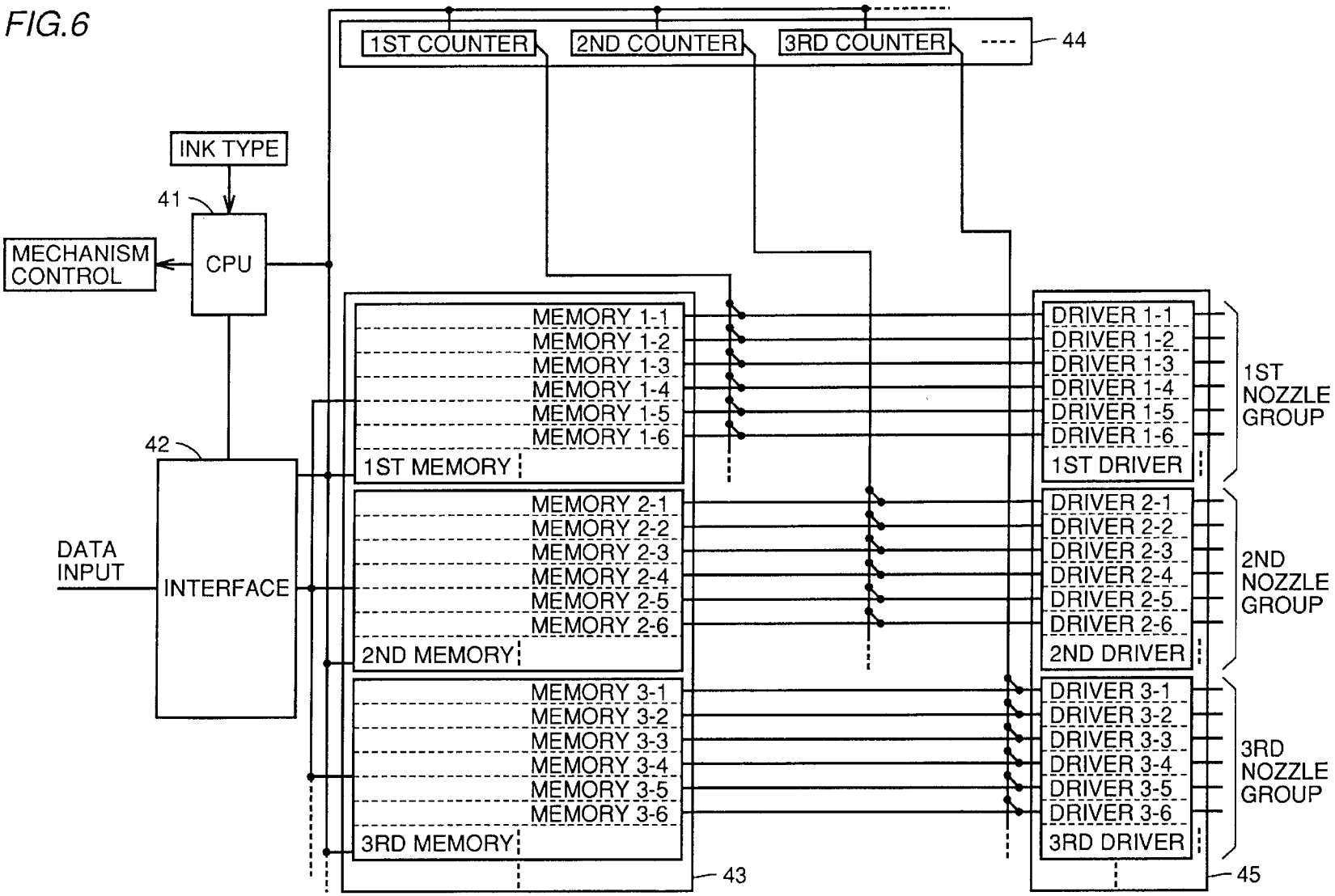
FIG. 6 is a block diagram showing a structure of a control unit of the printer for textile printing in accordance with the first embodiment.

Referring to FIG. 6, the control unit of the printer for textile printing includes a CPU (Central Processing Unit) 41 for overall control, an interface 42 for receiving external print data, a memory group 43 for storing received print data for each nozzle 12, a counter group 44 for storing the number of ink emission set for each ink, and a driver group 45 for controlling ink emission in accordance with the print data stored in the memory group 43 and the number of ink emission stored in the counter group 44. Ink types are given from an ROM, not shown, to CPU 41. CPU 41 outputs an instruction for controlling printer mechanism.

CPU 41 presets the number of emission of the ink at each counter of counter group 44, dependent on the ink type. After printing of data corresponding to one line, the head emits ink by the number of emission set at each counter, at a position opposing to ink receiving equipment 9.

The width of an ink receiving opening of ink receiving equipment 9 is narrower than the width of the ink jet head in the direction of travel, and the ink is emitted successively from the head which has moved and came to be opposed to the ink receiving opening. The type of ink emitted from each nozzle 12 is determined in accordance with the content to be printed before the start of printing, and inks of desired types are filled in ink tanks 6.

Figure 7A:
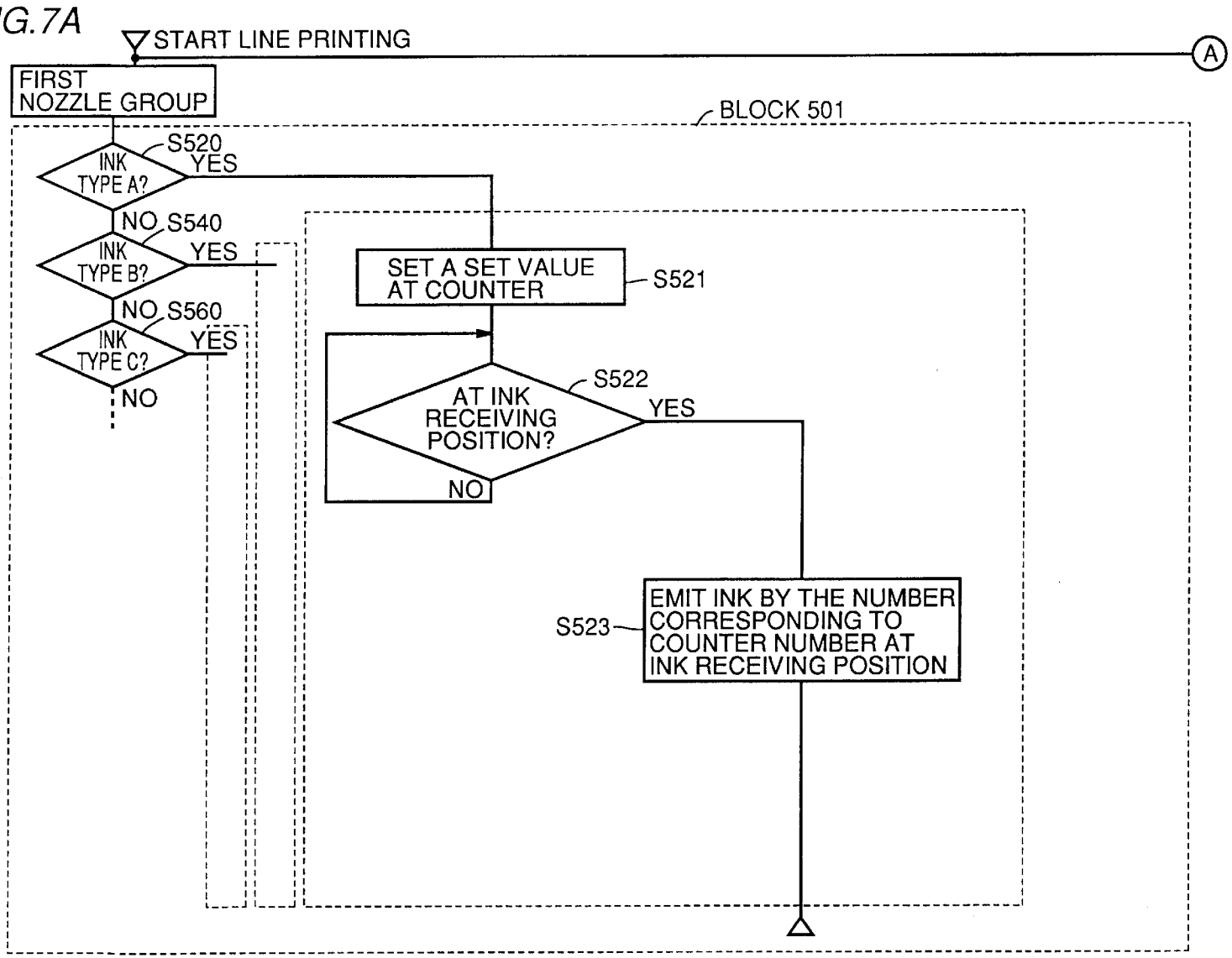
FIGS. 7A and 7B are flow charts of ink purge control in accordance with the first embodiment.
Figure 7B:
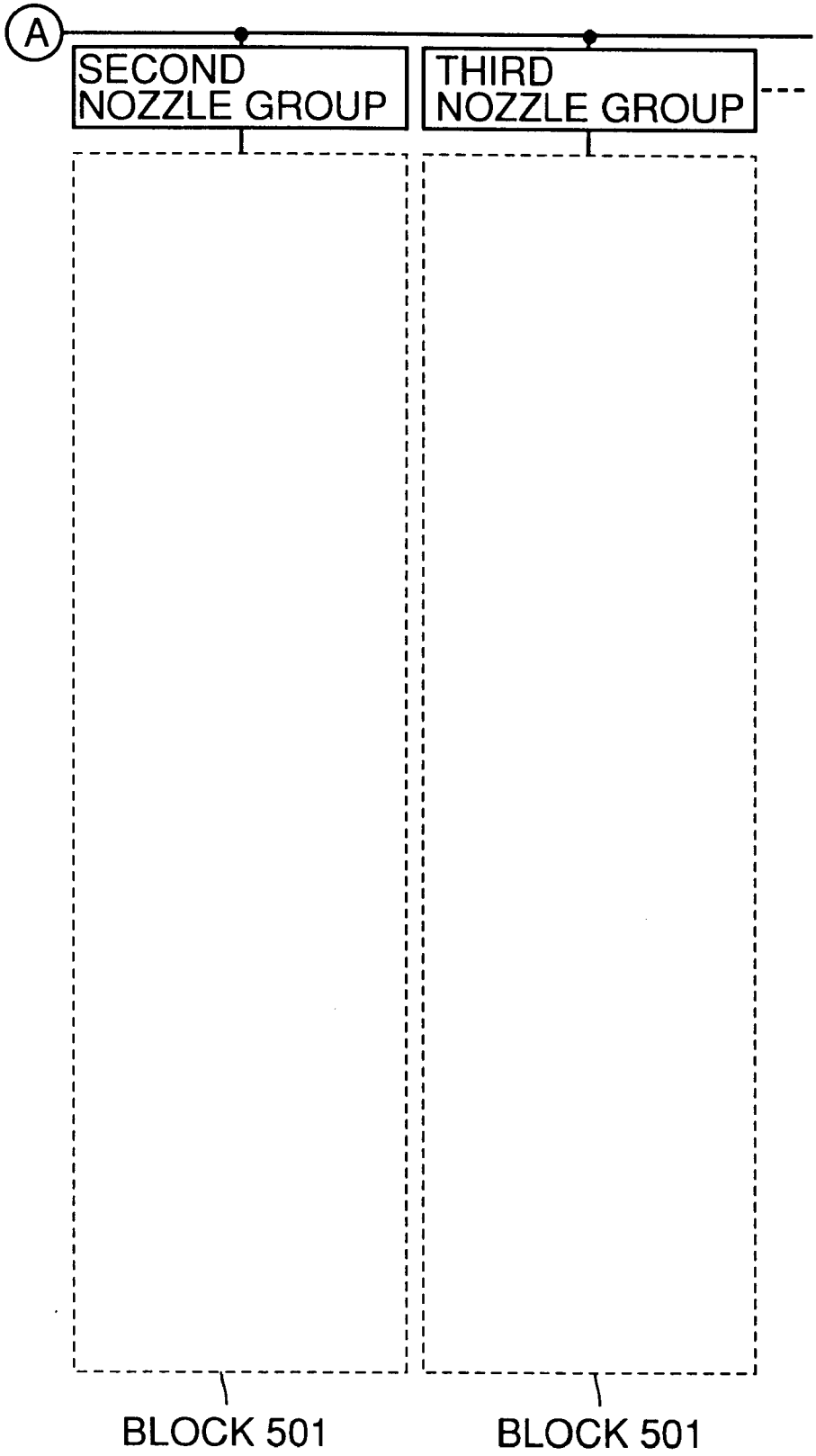

Referring to FIGS. 7A and 7B, the flow of ink purge control will be described. The ink purge control refers to control related to ink emission for preventing jamming of nozzle 12 caused by drying of ink. In the ink purge control, the process in block 501 is repeated for each of a prescribed number of nozzle groups starting from the first nozzle group.

CPU 41 determines whether ink type is "A" or not in the first nozzle group (S520). If the ink type is not "A" (NO in S520), CPU 41 determines whether the ink type is "B" or not (S540). In this manner, the ink type of the first nozzle group is determined. If the ink type is "A" (YES in S520), the number of ink emission for the ink type "A" is set in a first counter (S521). After printing of data corresponding to one line, whether the position of nozzle 12 is opposed to ink receiving equipment 9 or not is determined (S522). If nozzle 12 is at a position not opposing to ink receiving equipment 9 (NO in S522), the process of S522 is repeated until the nozzle is positioned opposing to ink receiving equipment 9. When the nozzle reaches the position opposing to ink receiving equipment 9 (YES in S522), the ink jet head emits the ink by the number set in the first counter, to ink receiving equipment 9 (S523).

The ink purge control described above is performed every time the data corresponding to one line is printed. Namely, ink emission to ink receiving equipment 9 is performed at every one reciprocation of the ink jet head. Accordingly, ink drying can surely be prevented, and only a small amount of ink need be emitted to ink receiving equipment 9. The number of emission of the ink emitted to ink receiving equipment 9 is set dependent on the ink type. Therefore, even when inks having different properties are used, jamming of orifices 13 by ink drying can be prevented. This enables printing with high resolution and high precision.

Though ink subtanks 2 for 8 colors are shown in FIG. 2, the subtanks may have a structure for 4 colors for basic Y, M, C and B, or may further include the structure for gold, silver or one color with different tones.

Figure 8:
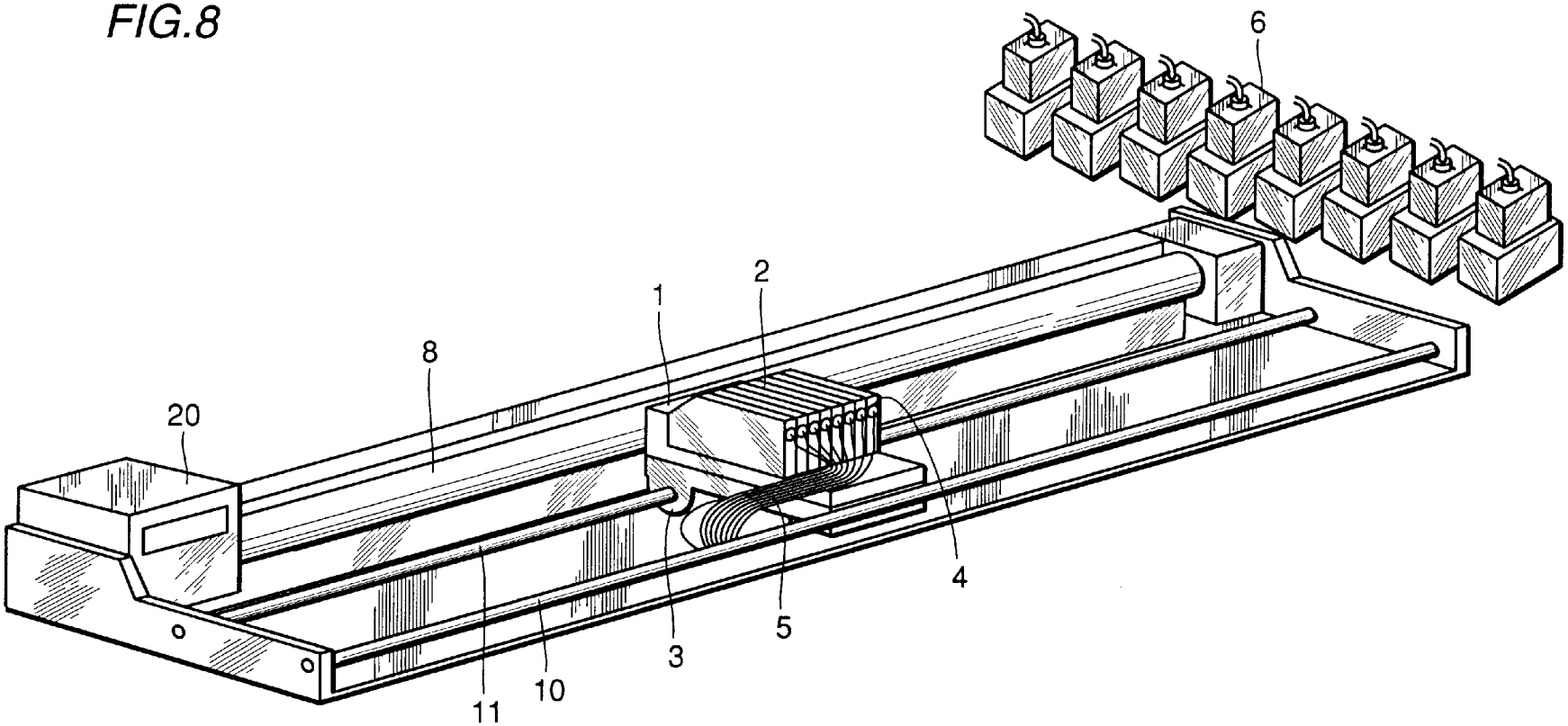
FIG. 8 shows a basic structure of a printer for textile printing in accordance with the first embodiment.

Referring to FIG. 8, an ink receiving equipment 20 may be formed integrally with a maintenance station for preventing drying of the head and for preventing trouble such as ink emission failure. This enables reduction in size of the printer apparatus.

Figure 9A:
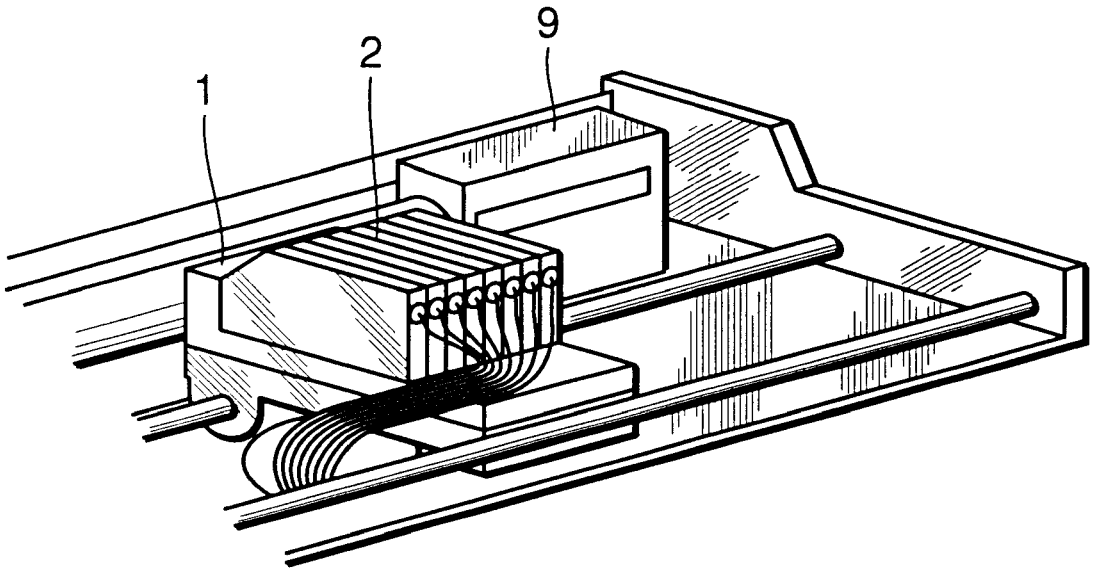
FIGS. 9A and 9B show positional relation between the ink receiving equipment and the head portion of the printer for textile printing shown in FIG. 8.
Figure 9B:
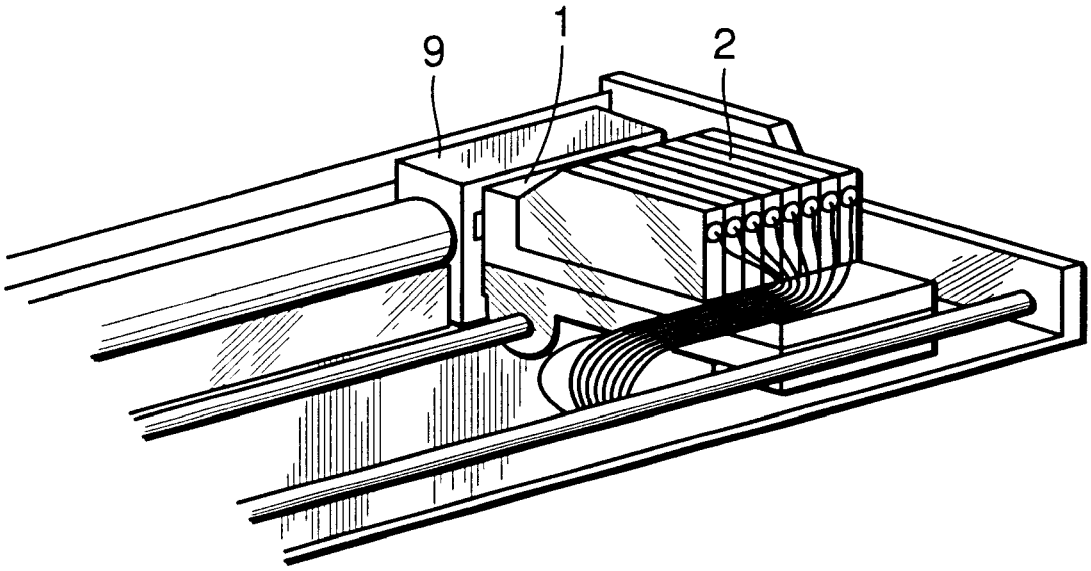

Referring to FIG. 9A, the width of ink receiving equipment 9 may be wider than the width of the print head. In that case, referring to FIG. 9B, it is possible for respective nozzles to emit inks at one time in synchronization with reversal in the direction of running of head body 1. This simplifies control of the printer apparatus.

Figure 10:
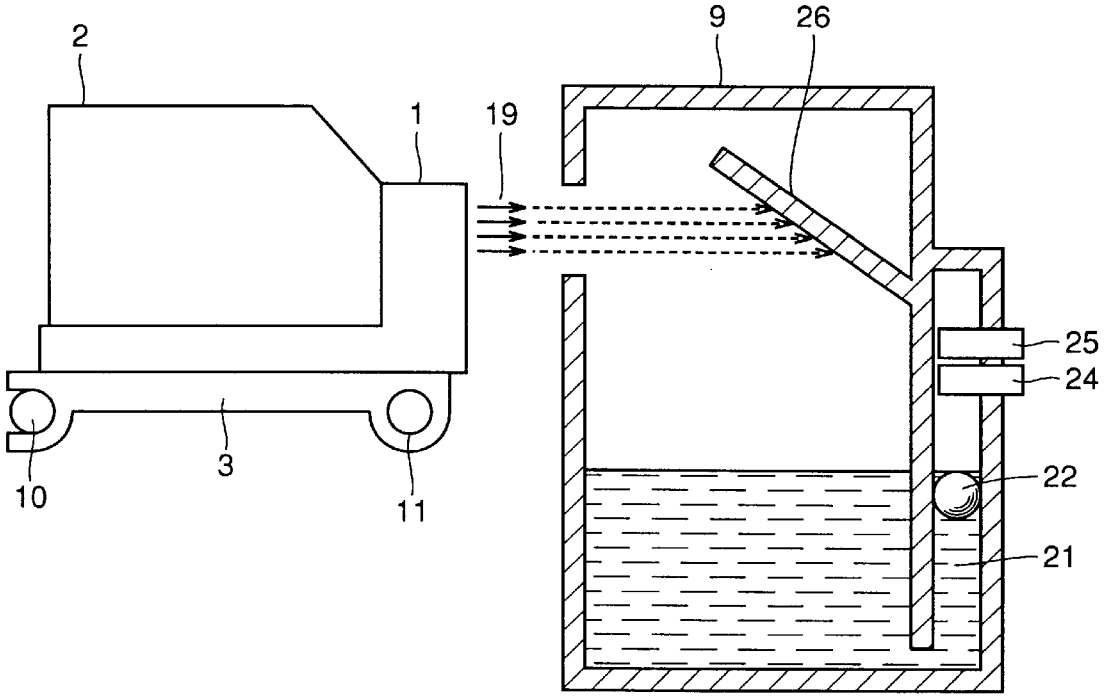
FIG. 10 shows a structure of the ink receiving equipment in accordance with the first embodiment.

Referring to FIG. 10, ink receiving equipment 9 may have the following structure. Ink receiving equipment 9 is provided with a sensing float 22 floating on discharged ink 21, and a first sensor 24 for detecting sensing float 22 at a prescribed height position. Ink receiving equipment 9 further includes a second sensor 25 for detecting sensing float 22 at a position higher than first sensor 24, and receiving plate 26 for receiving the ink emitted from nozzle 12.

Figure 11:
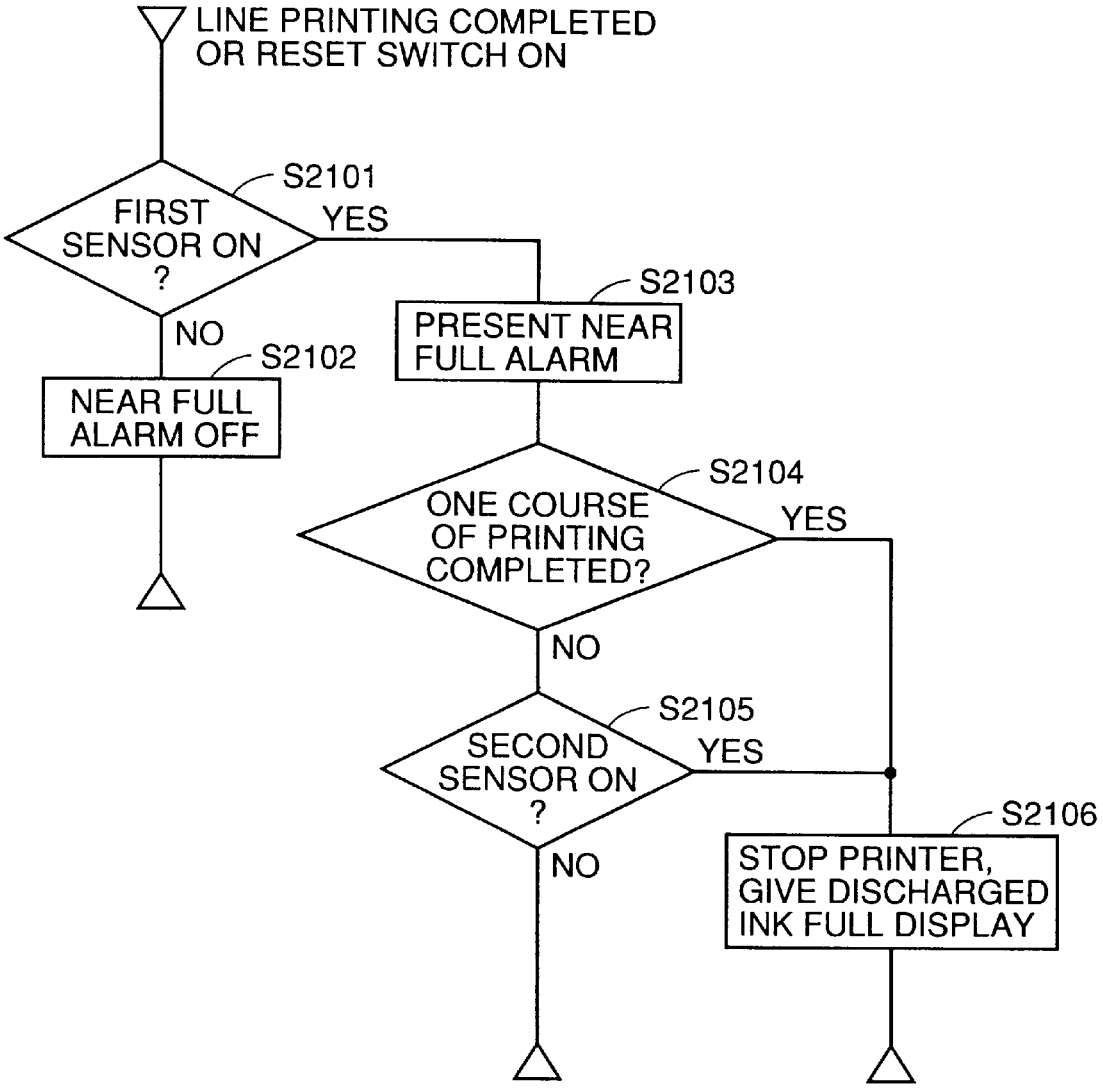
FIG. 11 is a flow chart showing a control of the ink receiving equipment of FIG. 10.

Referring to FIG. 11, flow of control related to discharged ink 21 will be described.

The control is started immediately after printing data corresponding to one line, or started by turning ON of a reset switch. Whether the first sensor 24 is ON or not is determined (S2101). If the first sensor 24 is OFF (NO in S2101), the level of discharged ink 21 is still low. Therefore, the alarm of near full is not given (S2102), and the discharged ink level flag is kept OFF.

When the first sensor 24 is ON (YES in S2101), it means that the discharge ink 21 attains a high level, and a near full alarm is given (S2103). Thereafter, whether one course of printing is completed or not is determined (S2104). If printing of one course is completed, a display is given indicating that the discharged ink 21 is at the full level, and the printer is stopped (S2106). After the printer is stopped, the discharged ink is discarded.

When printing of one course is not completed (NO in S2104), whether the second sensor 25 is ON or not is determined (S2105). If the second sensor 25 is ON (YES in S2105), the process proceeds to S2106, and the control is terminated. If the second sensor 25 is OFF, it means that there is a margin until the ink reaches the full level. Therefore, the flow waits for completion of ink control processing and printing of the next data.

Even when the first sensor 24 is turned ON, it is possible to continuously drive the printer apparatus until the second sensor 25 is turned ON. By setting margin in height higher than the amount of ink necessary for one course between the first and second sensors 24 and 25, it becomes possible to prevent stopping of the printer amid the printing operation. Therefore, the line pattern, which is generated when the printer stops amid the printing operation, can effectively be prevented.

Ink receiving equipment 9 is detachable. Therefore, when it is filled with discharged ink 21, ink receiving equipment 9 may be detached to discard the discharged ink 21. Alternatively, ink receiving equipment 9 filled with discharge ink 21 may be detached and replaced by a new ink receiving equipment 9.

Figure 12:
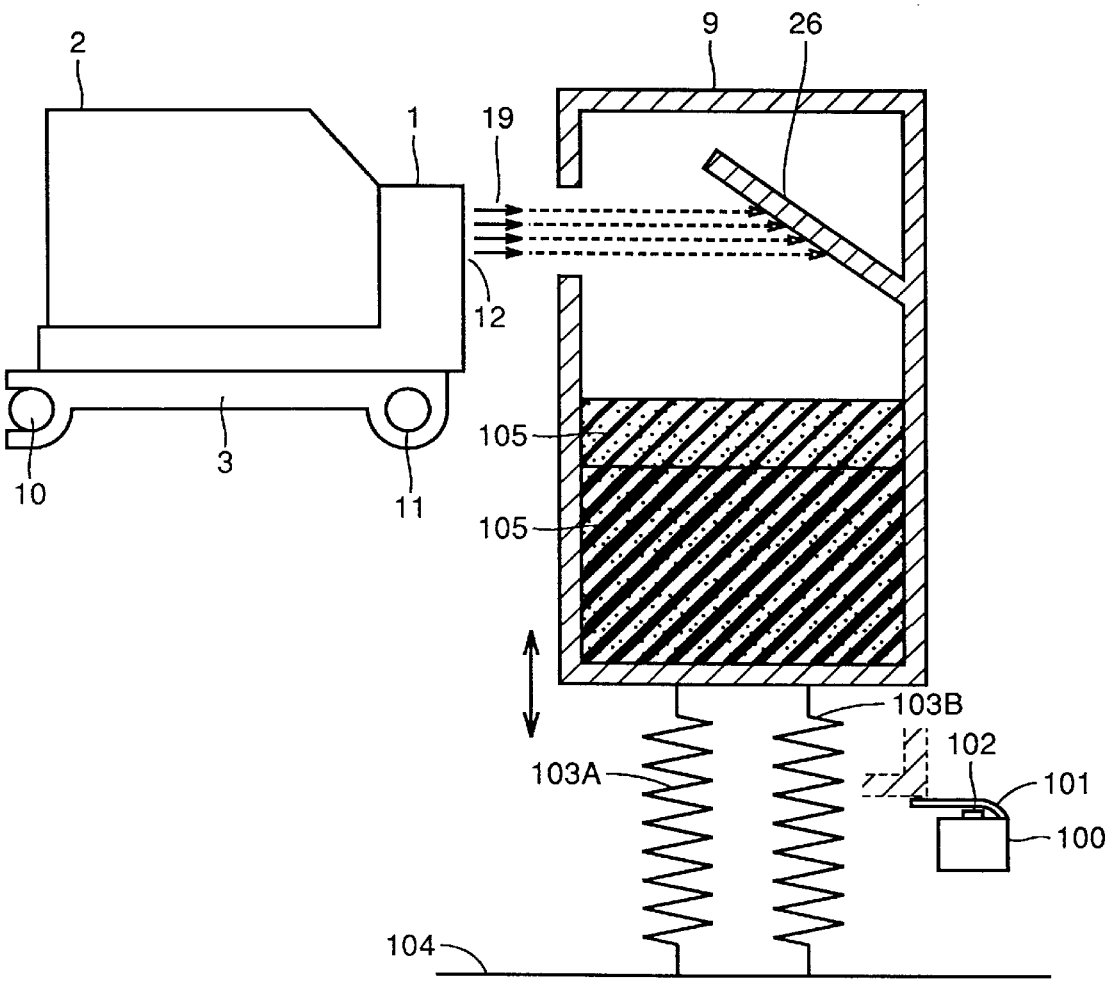
FIG. 12 shows a structure of the ink receiving equipment in accordance with the first embodiment.

Referring to FIG. 12, a porous member 105 with good absorption property, such as a sponge may be provided in a container of ink receiving equipment 9, with ink receiving equipment 9 adapted to be movable in upward/downward directions and spring members 103A and 103B may be provided below ink receiving equipment 9. Spring members 103A and 103B are fixed, each at one end to the printer body, and fixed at the other end, at a lower portion of ink receiving equipment 9. Ink receiving equipment 9 moves in the direction of the arrow by the weight of the discharged ink. As the discharged ink is pooled, the lower portion of ink receiving equipment 9 is brought into contact with a detection bar 101 of a detection switch 100, and ink receiving equipment 9 presses detection bar 101 down. The pressed detection bar 101 comes into contact with a terminal 102, so that it is detected that the ink receiving equipment 9 is full. Since ink receiving equipment 9 has porous member 105 contained therein, discharged ink inside the ink receiving equipment 9 does not leak to the outside even when the ink receiving equipment 9 moves upward/downward or when the ink receiving equipment 9 is detached from the position.

Second Embodiment

A main portion of the printer for textile printing in accordance with the second embodiment is similar to the main portion of the printer for textile printing in accordance with the first embodiment. Therefore, description thereof is not repeated.

Figure 13:
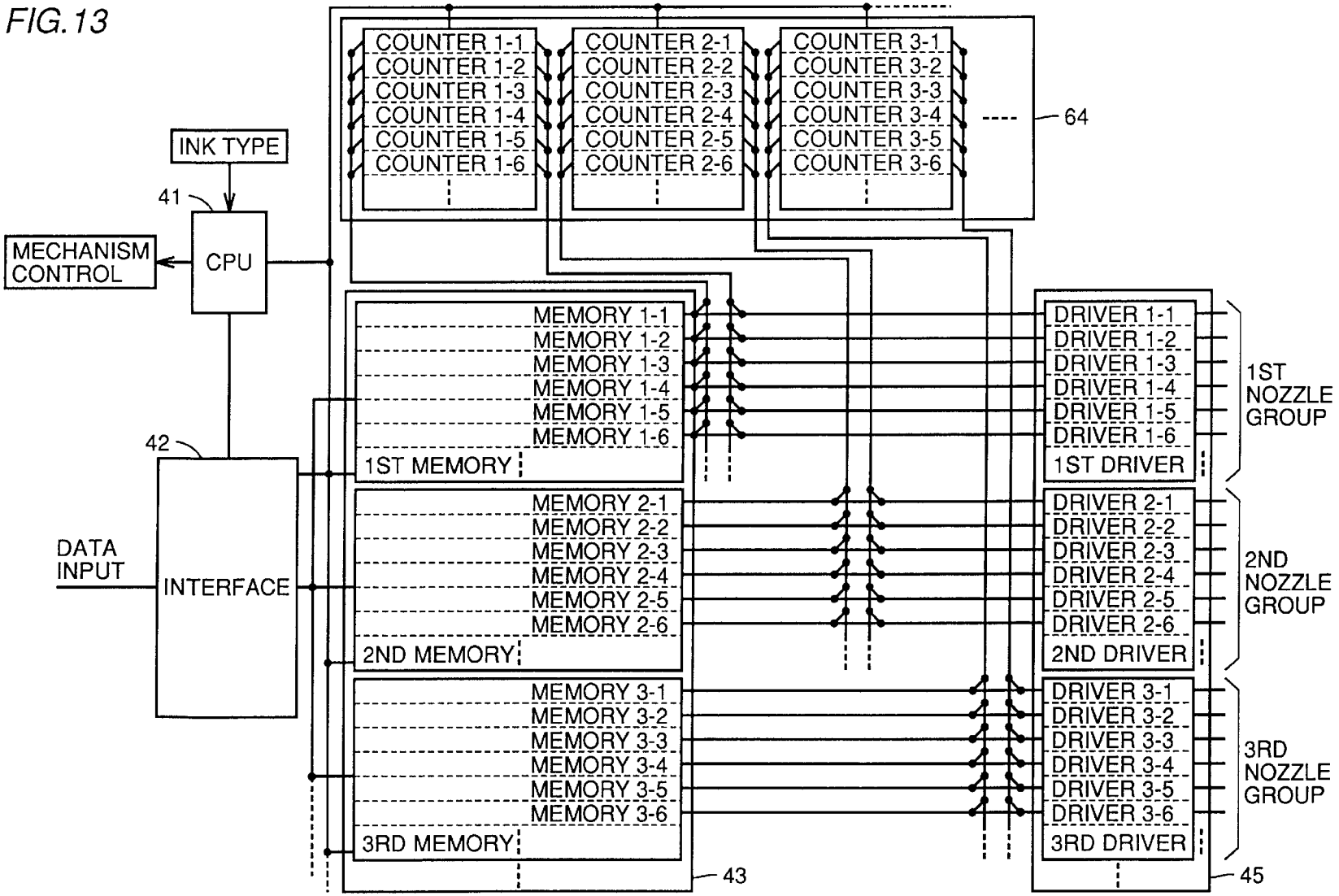
FIG. 13 is a block diagram showing a structure of a control unit of a printer for textile printing in accordance with a second embodiment.

Referring to FIG. 13, the control unit of the printer for textile printing includes a CPU 41 for overall control, an interface 42 for receiving external print data, a memory group 43 for storing received print data for each nozzle 12, a counter group 64 for storing the number of ink emission set for each ink, and a driver group 45 for controlling ink emission in accordance with the print data stored in memory group 43 and the number of ink emission stored in counter group 64. Ink types are given from an ROM, not shown, to CPU 41. CPU 41 outputs an instruction for controlling printer mechanism.

CPU 41 presets the number of emission corresponding to each ink at each counter of counter group 64, dependent on the ink type. CPU 41 decrements the counter value every time ink emission takes place. When the counter value is not 0 after completion of printing, the head emits the ink until the counter value reaches 0, at a position opposing to ink receiving equipment 9.

Figure 14A:
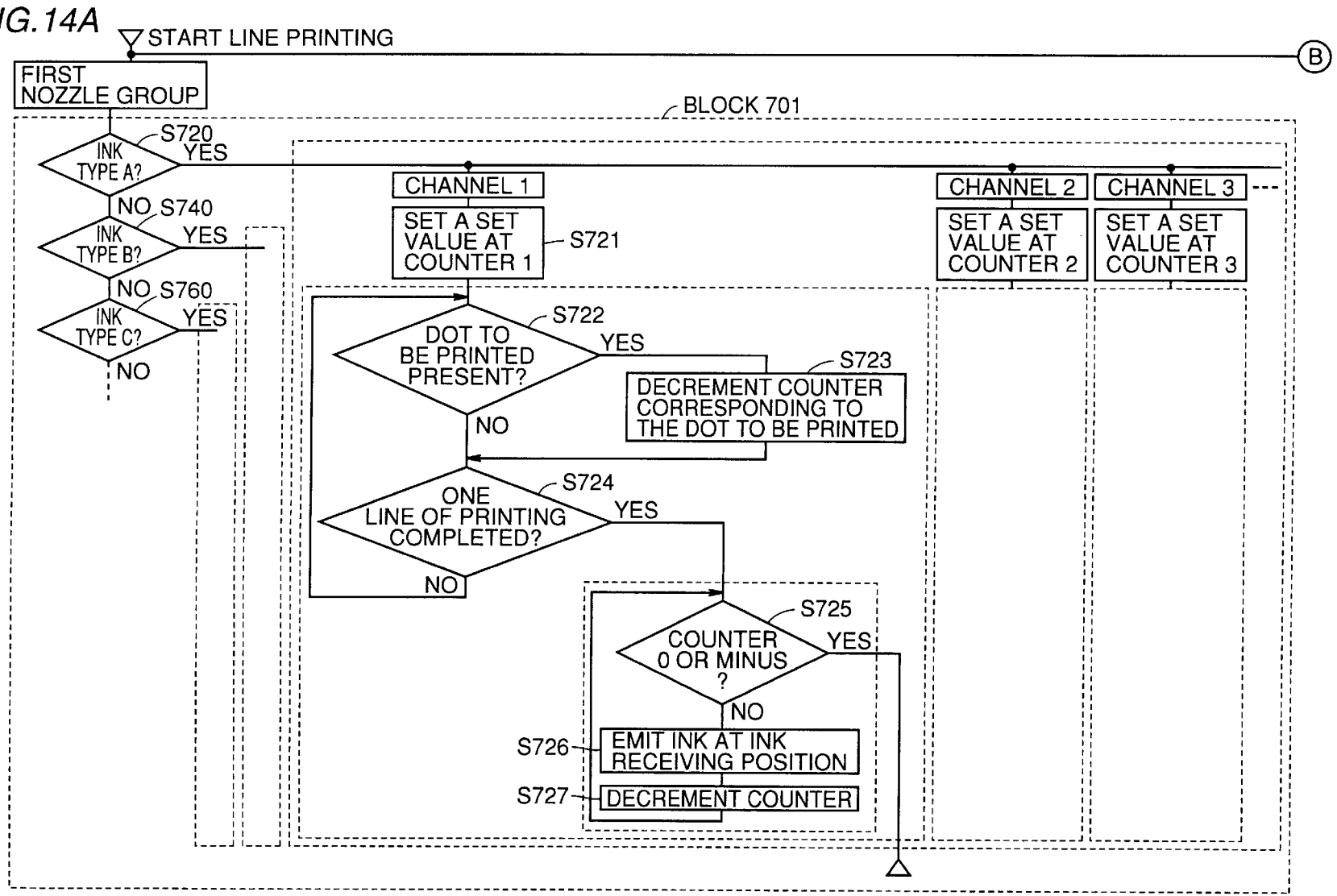
FIGS. 14A and 14B are flow charts of ink purge control in accordance with the second embodiment.
Figure 14B:
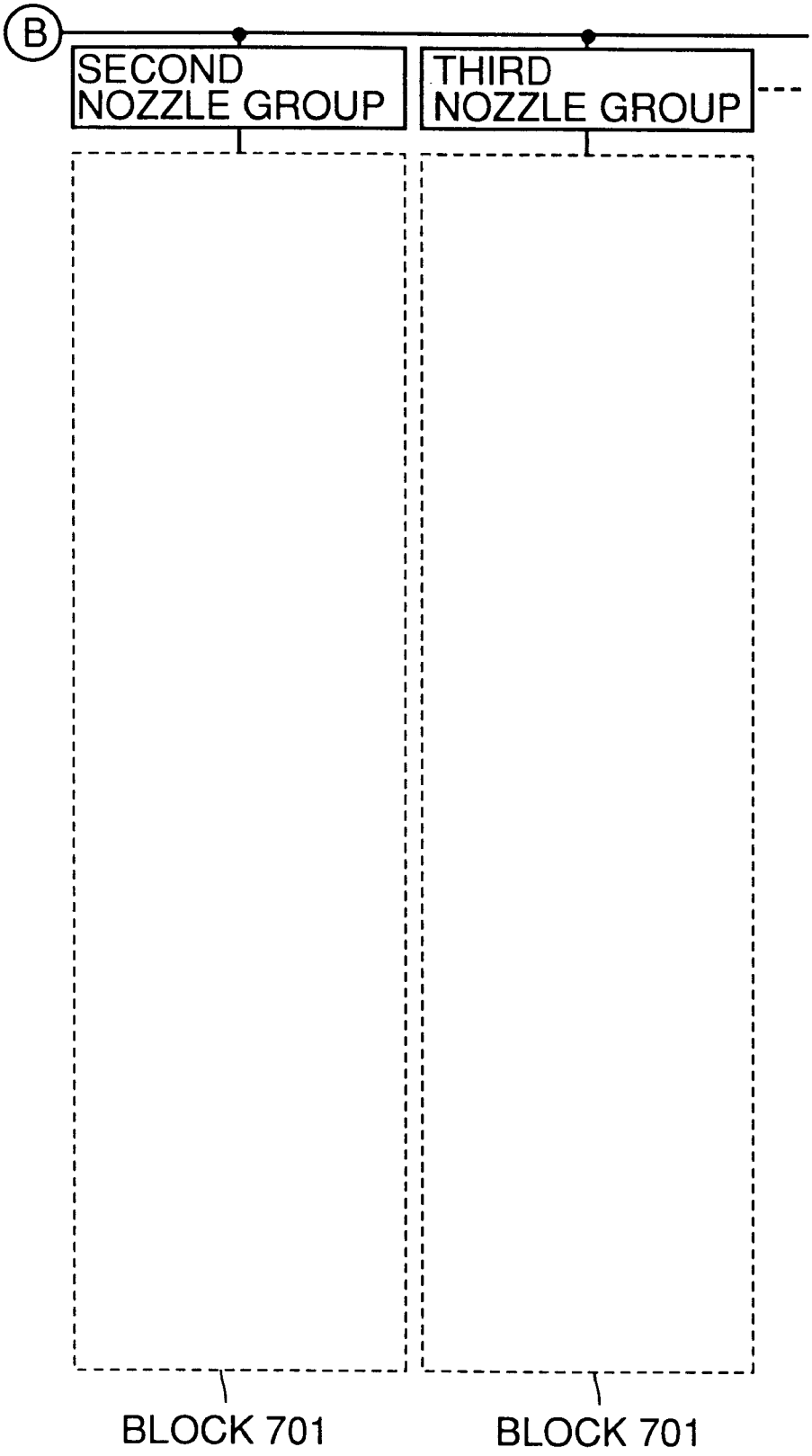

Referring to FIGS. 14A and 14B, the flow of ink purge control will be described. In the ink purge control, the process of a block 701 is repeated for respective nozzle groups starting from the first nozzle group.

CPU 41 determines whether the ink type is "A" or not in the first nozzle group (S720). If the ink type is not "A" (NO in S720), CPU 41 determines whether the ink type is "B" or not (S740). In this manner, the ink type of the first nozzle group is determined. If the ink type is "A" (YES in S720), the number of ink emission of ink type "A" is preset at a channel 1 of counter 1 (counter 1-1) (S721). It is determined whether there is any dot to be printed (S722). If there is a dot or dots to be printed (YES in S722), the number of dots to be printed is decremented in counter 1-1, and data is printed (S723). If there is not any dot to be printed (NO in S722), or after termination of the process of S723, whether printing of data corresponding to one line has been completed or not is determined (S724).

If printing of data corresponding to one line has not yet been completed (NO in S724), the flow returns to S722, and the above described process is repeated until printing of one line is completed. If printing of one line has been completed (YES in S724), whether the value of counter 1-1 is 0 or smaller is determined (S725). If the value of counter 1-1 is positive (NO in S725), it means that ink emission of the set number has not yet been performed, and therefore ink is emitted once when nozzle 12 reaches a position opposing to ink receiving equipment 9 (S726). Thereafter, the value of counter 1-1 is decremented by one (S727), the flow returns to S725, and the process from S725 to S727 is repeated until the value of counter 1-1 reaches 0 or smaller. When the value of counter 1-1 attains 0 or smaller (YES in S725), it means that ink is emitted for the number of times larger than that set in counter 1-1, and hence printing of one line is completed. Control is performed in the similar manner for other channels of the first nozzle group successively.

Each nozzle 12 emits ink for the number of times set for each ink of different type without fail. Therefore, the problem of jamming of the orifice caused by ink drying can be prevented. Especially, the value of purge ink dot number is set to be the value when "set value—printed dot number" attains positive, and the purge ink dot number is determined in consideration of the number of ink emission at the time of printing data (number of printed dots). Therefore, wasteful ink emission is prevented and consumption of ink can be suppressed.

Third Embodiment

The main portion of the printer for textile printing in accordance with the third embodiment is similar to the main portion of the printer for textile printing in accordance with the first embodiment. Therefore, description thereof is not repeated.

Figure 15:
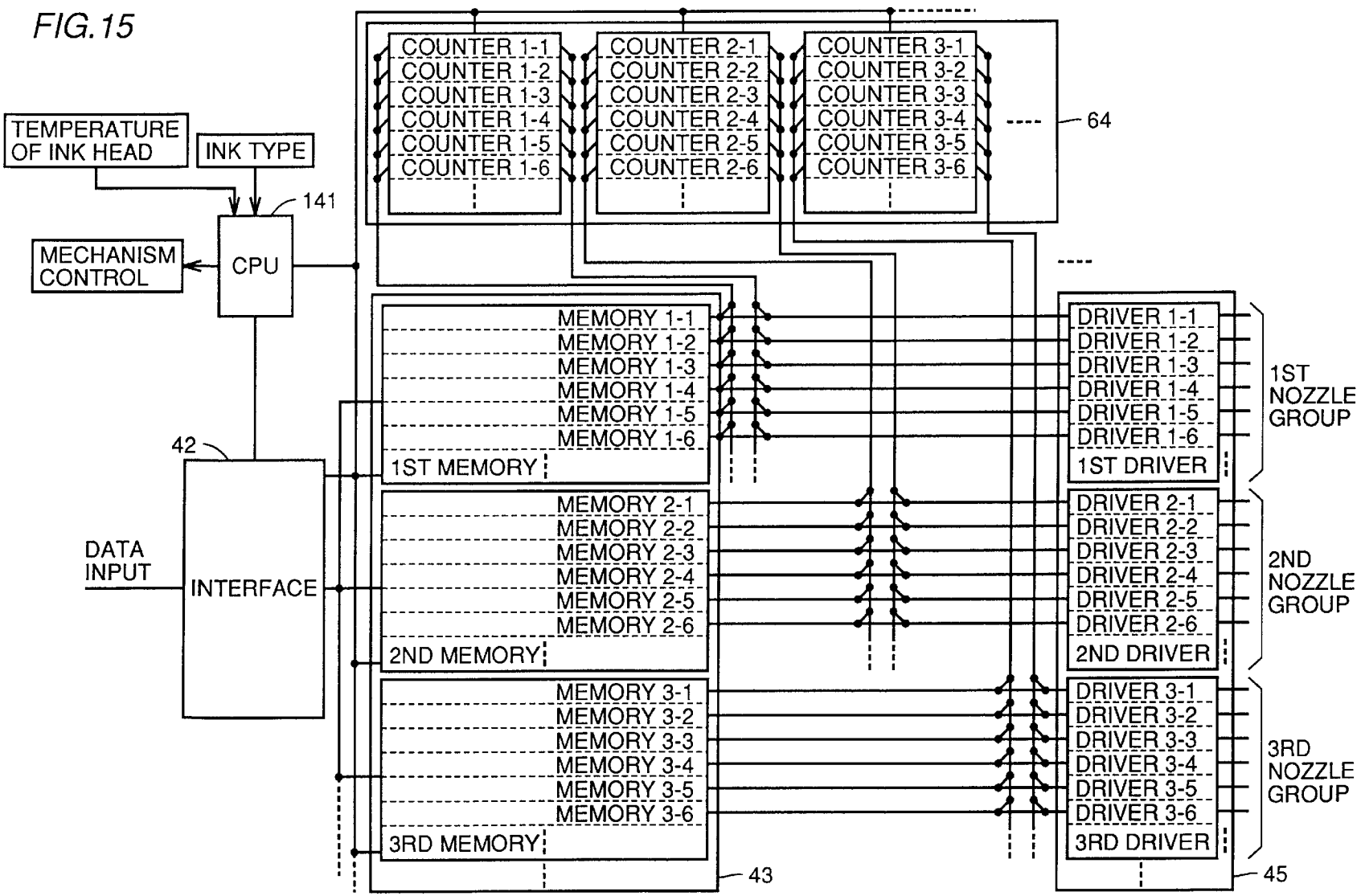
FIG. 15 is a block diagram showing a structure of a control unit of a printer for textile printing in accordance with a third embodiment.

Referring to FIG. 15, the control unit of the printer for textile printing includes a CPU 141 for overall control, an interface 42 for receiving external print data, a memory group 43 for storing received print data for every nozzle 12, a counter 64 for storing the number of ink emission set for each ink, and a driver group 45 for driving control of ink emission in accordance with the print data stored in memory group 43 and the number of ink emissions stored in counter group 64. Ink type is given from an ROM, not shown, and a temperature of the print head is given from a thermometer, not shown, to CPU 141. CPU 141 outputs an instruction for controlling printer mechanism.

CPU 141 presets the number of emission corresponding to each ink at each counter of counter group 64, in accordance with the ink type and the temperature of the print head. Every time ink is emitted, CPU 141 decrements the counter value. When the counter value is not 0 at the completion of printing of data corresponding to one line, the head emits ink until the counter value reaches 0, at a position opposing to ink receiving equipment 9.

Figure 16:
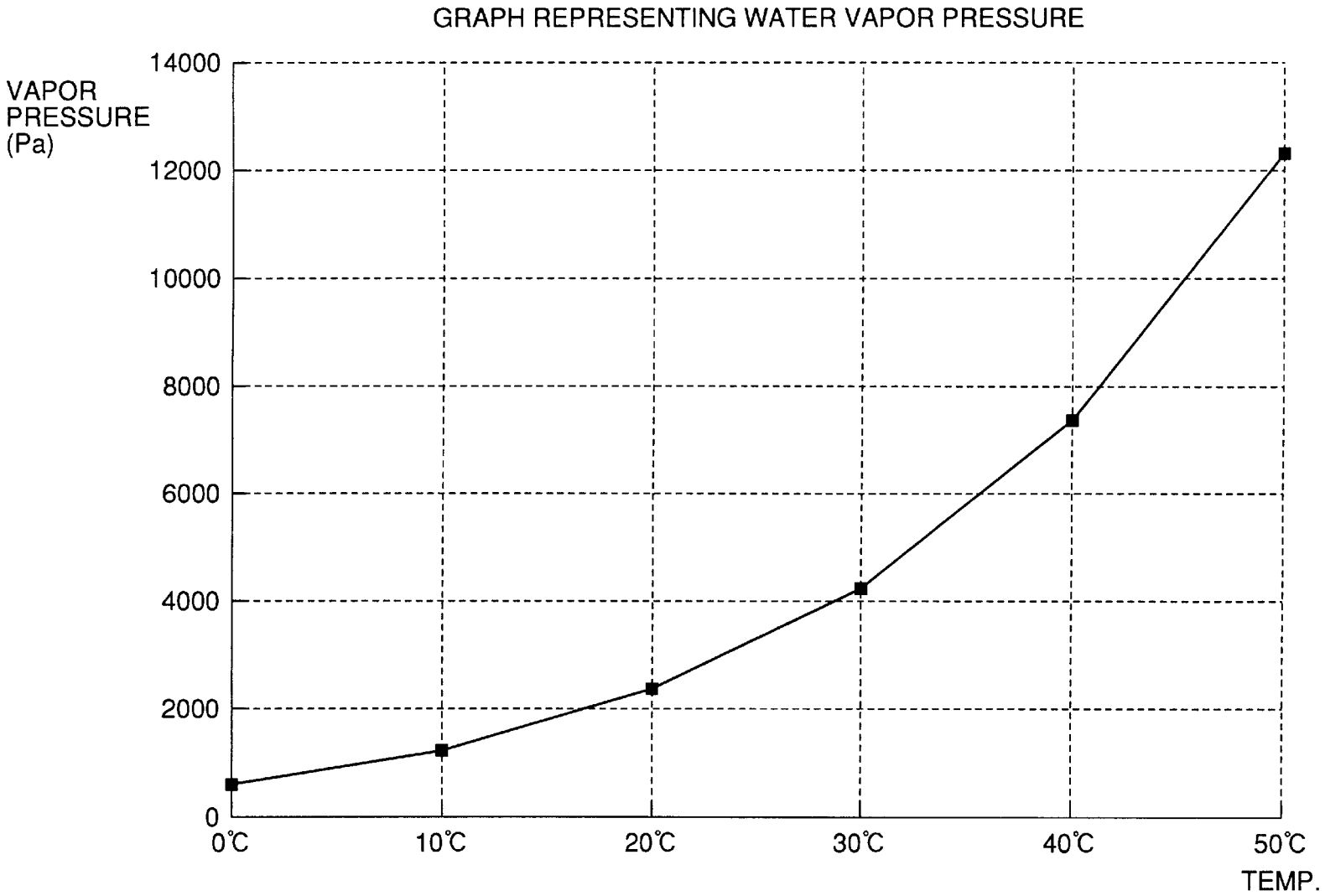
FIG. 16 is a graph showing vapor pressure of water.

Referring to FIG. 16, the number of emission set in advance at each counter of counter group 64 is set based on tendency of ink evaporization with respect to temperature (relation between temperature and vapor pressure of water). For example, when the temperature is 20° C., the number of ink emission should preferably be about 1.9 times that at the temperature of 10° C., and when the temperature is 30° C., the number of ink emission should preferably be set to about 3.4 times that when the temperature is 10° C.

Figure 17A:
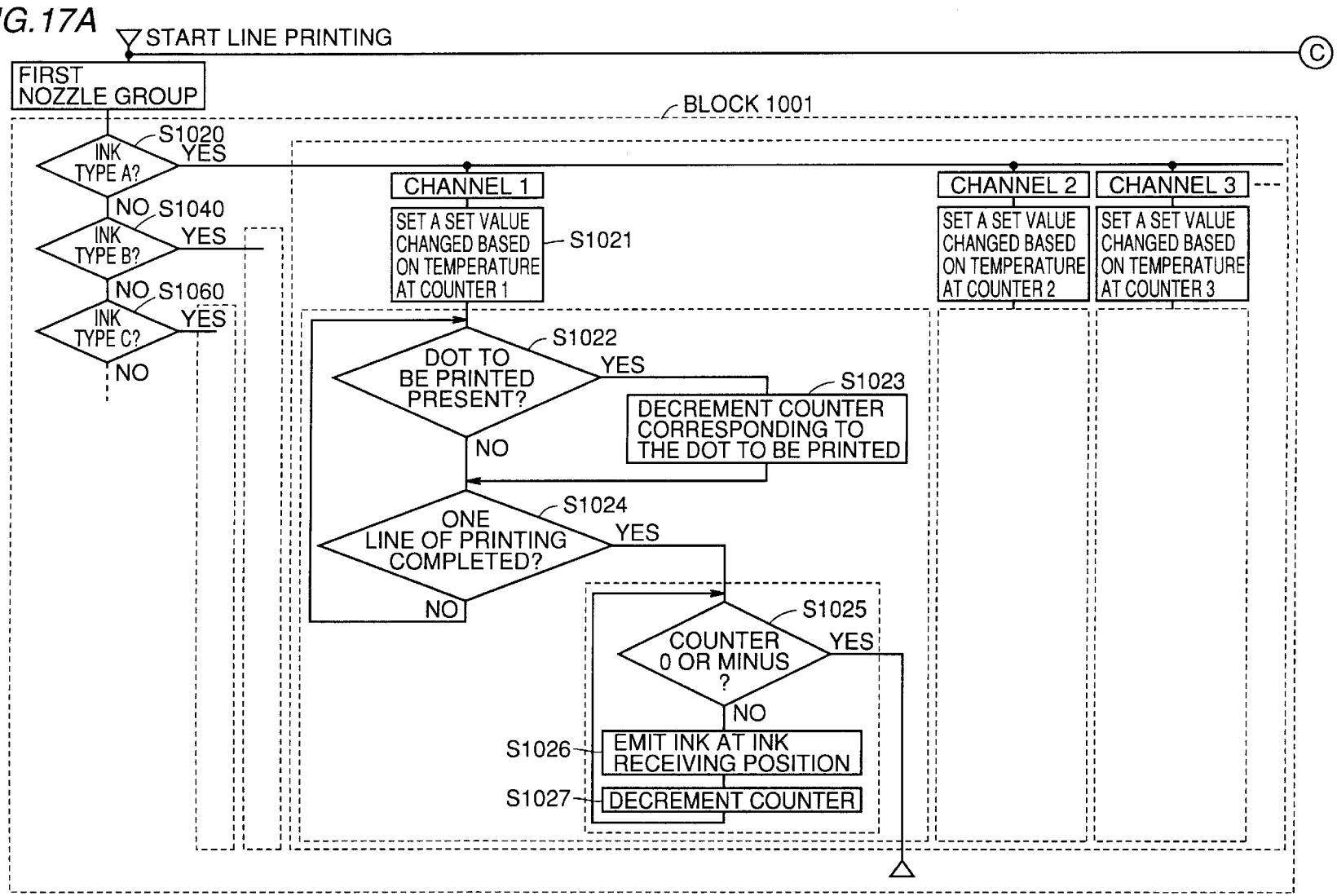
FIGS. 17A and 17B are flow charts of ink purge control in accordance with the third embodiment.
Figure 17B:
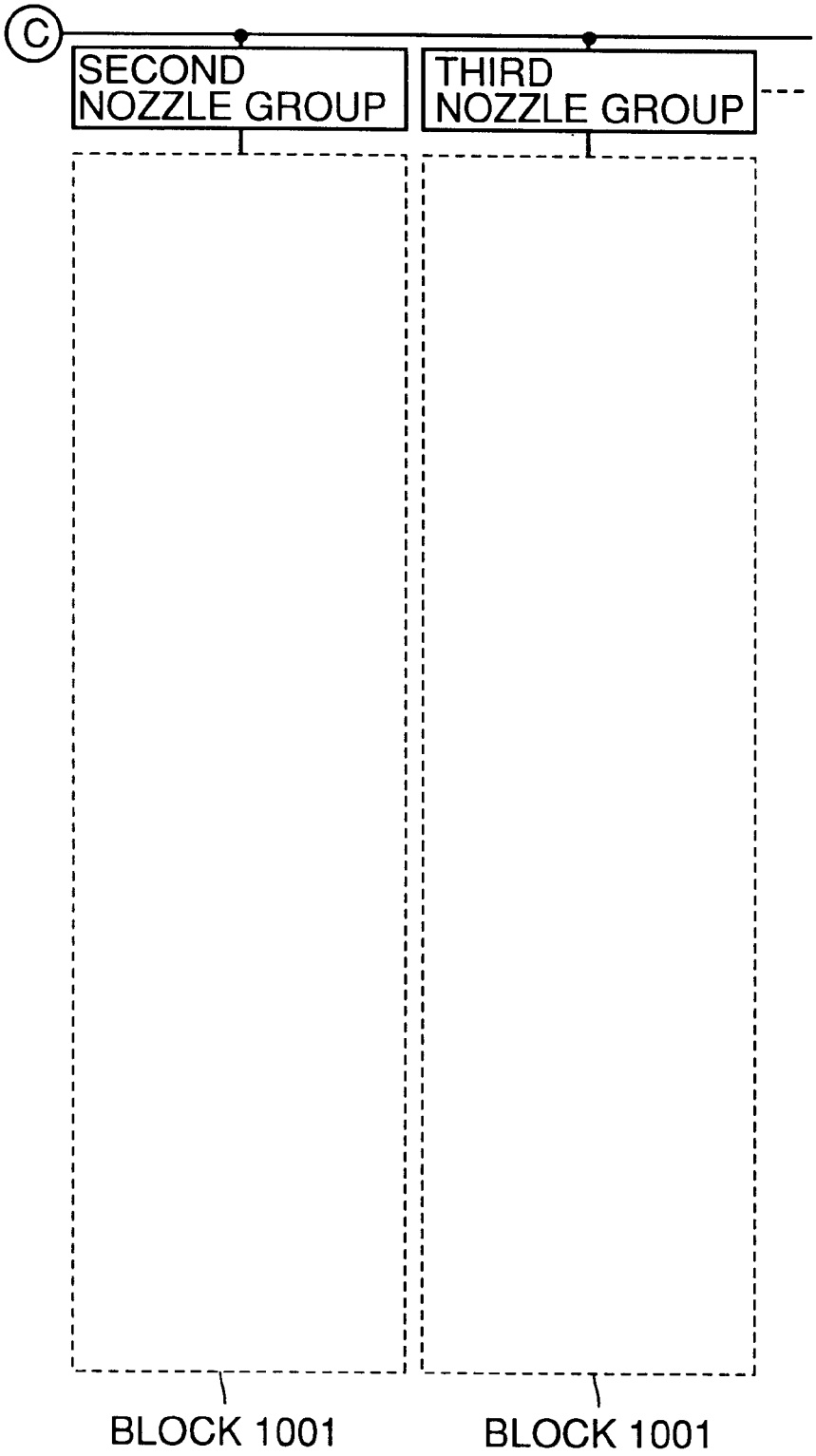

Referring to FIGS. 17A and 17B, the flow of ink purge control will be described. In the ink purge control, the process of block 1001 is repeated for respective nozzle groups starting from the first nozzle group.

CPU 141 determines whether ink type is "A" or not in the first nozzle group (S1020). If the ink type is not "A" (NO in S1020), CPU 141 determines whether the ink type is "B" or not (S1040). In this manner, the ink type of the first nozzle group is determined. When the ink type is "A" (YES in S1020), the number of ink emission of the ink type "A" is determined dependent on the temperature, and preset at a channel 1 of counter 1 (counter 1-1) (S1021). Whether there is any dot to be printed or not is determined (S1022). If there is a dot or dots to be printed (YES in S1022), the number of dots to be printed is decremented from counter 1-1, and data is printed (S1023). When there is not any dot to be printed (NO in S1022), or when process of S1023 is completed, whether printing of data corresponding to one line has been completed or not is determined (S1024).

If printing of data corresponding to one line has not yet been completed (NO in S1024), the flow returns to S1022, and the above described process is repeated until printing of data corresponding to one line is completed. If printing of data corresponding to one line has been completed (YES in S1024), whether the value of counter 1-1 is 0 or smaller is determined (S1025). If the value of counter 1-1 is positive (NO in S1025), it means that ink emission for the set number of times has not yet been performed. Therefore, ink is emitted once when the nozzle 12 reaches a position opposing to ink receiving equipment 9 (S1026). Thereafter, the value of counter 1-1 is decremented by one (S1027), the flow returns to S1025, and the process from S1025 to S1027 described above is repeated until the value of counter 1-1 reaches 0 or smaller. When the value of counter 1-1 reaches 0 or smaller (YES in S1025), it means that ink emission has been performed at least for the number of times set in counter 1-1, and printing of one line is completed. Similar control is performed successively on other channels of the first nozzle group.

Each nozzle 12 emits ink at least for the number of times set based on the ink type and the temperature of the print head without fail. Therefore, regardless of the speed of evaporation of each ink derived from variation of atmospheric temperature, wasteful ink emission, drying of the ink jet head and jamming of orifice because of the ink drying can be prevented. Further, the number of emission of ink to the ink receiving equipment 9 is counted, including the number of ink emission for printing the data. Therefore, ink consumption can be suppressed.

Fourth Embodiment

The main portion of the printer for textile printing in accordance with a fourth embodiment is similar to the main portion of the printer for textile printing in accordance with the first embodiment. Therefore, description thereof is not repeated.

Figure 18:
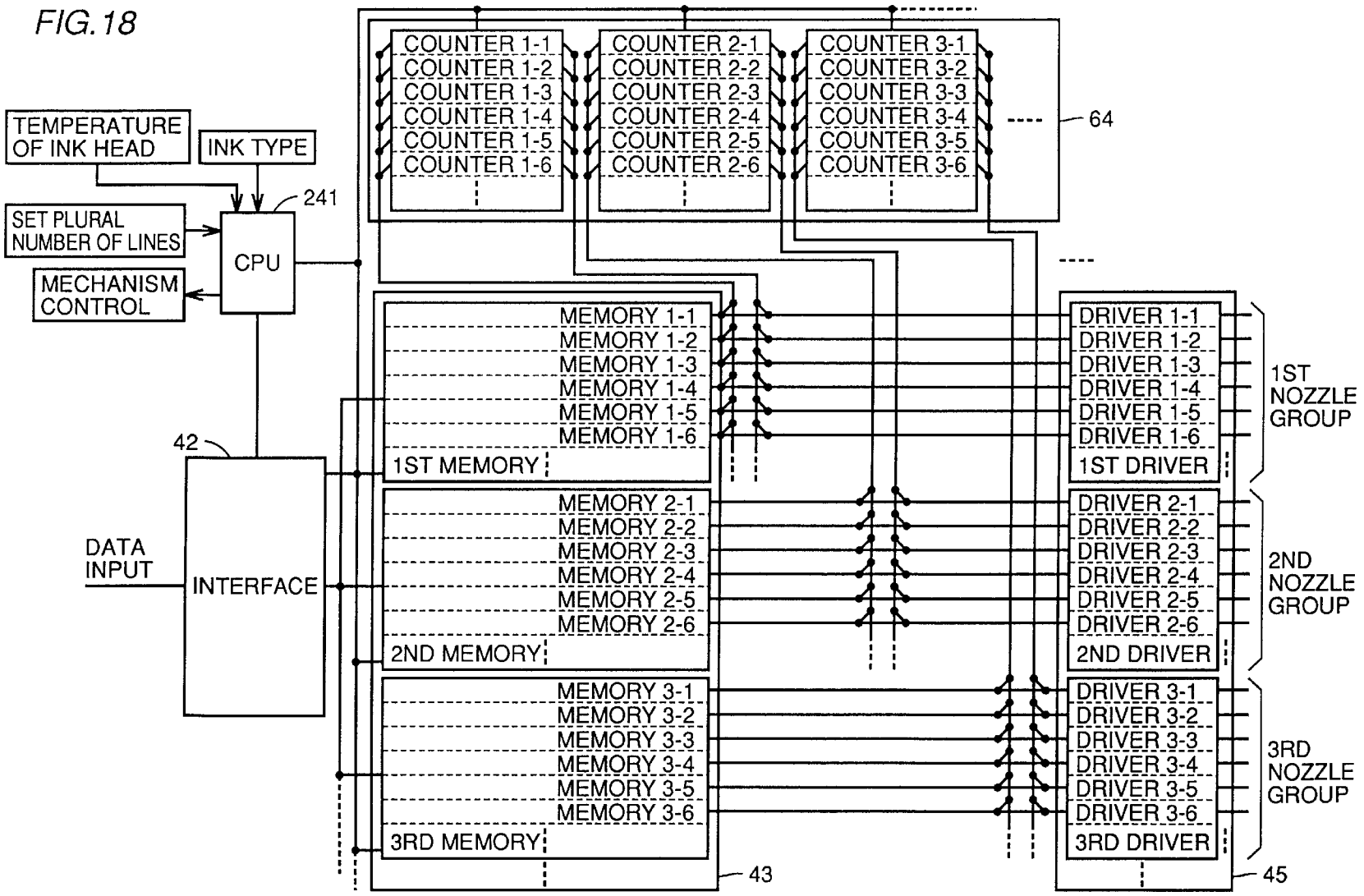
FIG. 18 is a block diagram showing a structure of a control unit of a printer for textile printing in accordance with a fourth embodiment.

Referring to FIG. 18, the control unit of the printer for textile printing includes a CPU 241 for overall control, an interface 42 for receiving external print data, a memory group 43 for storing received print data for each nozzle 12, a counter group 64 for storing the number of ink emission set for each ink, and a driver group 45 for controlling ink emission in accordance with the print data stored in memory group 43 and the number of ink emission stored in counter group 64. The ink type is given from an ROM, not shown, and the temperature of the print head is given from a thermometer, not shown, to CPU 241. A prescribed number of lines as a unit of ink emission is externally applied to CPU 241. Further, CPU 241 outputs an instruction for controlling printer mechanism.

Figure 19A:
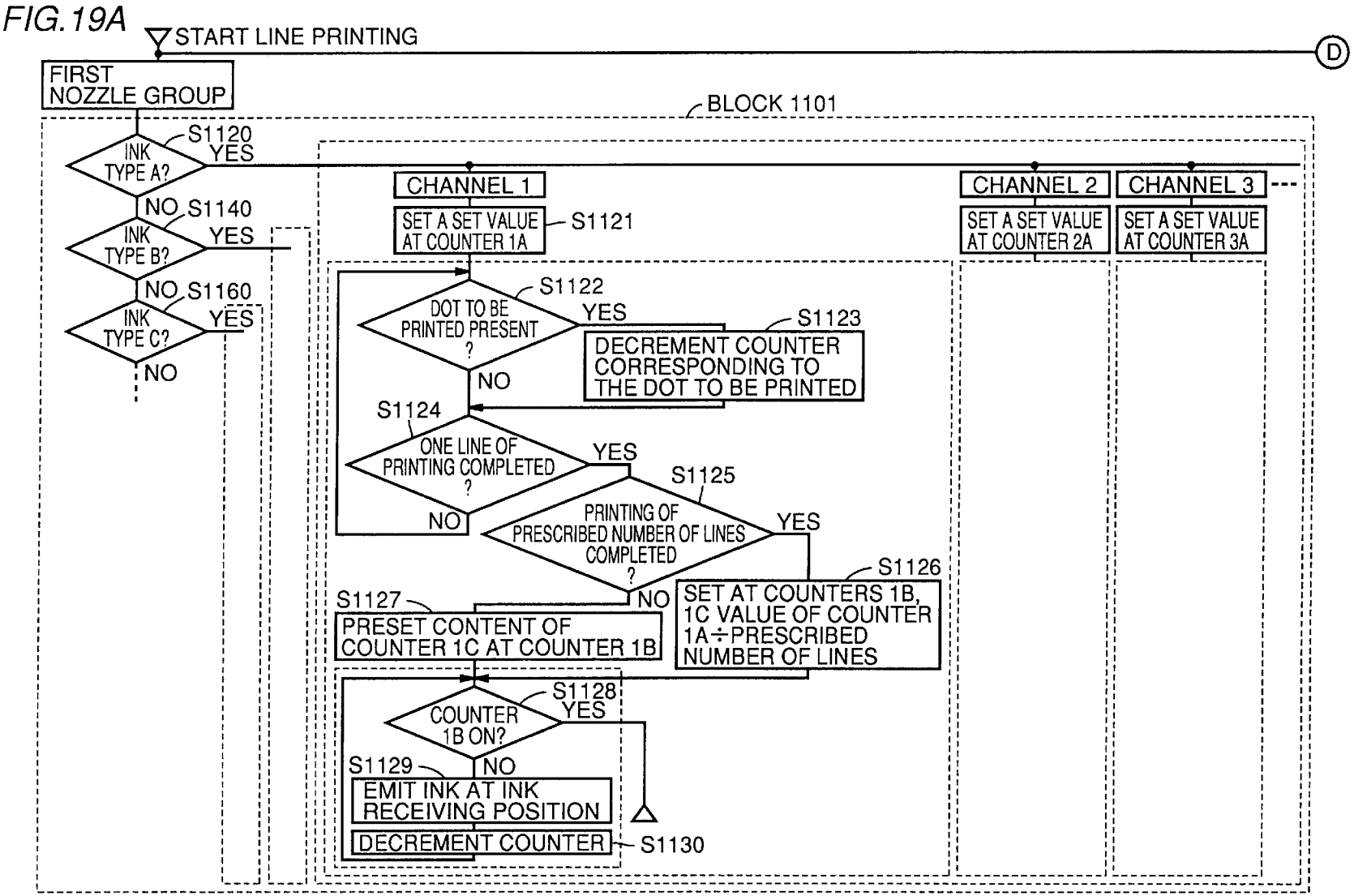
FIGS. 19A and 19B are flow charts of ink purge control in accordance with the fourth embodiment.
Figure 19B:
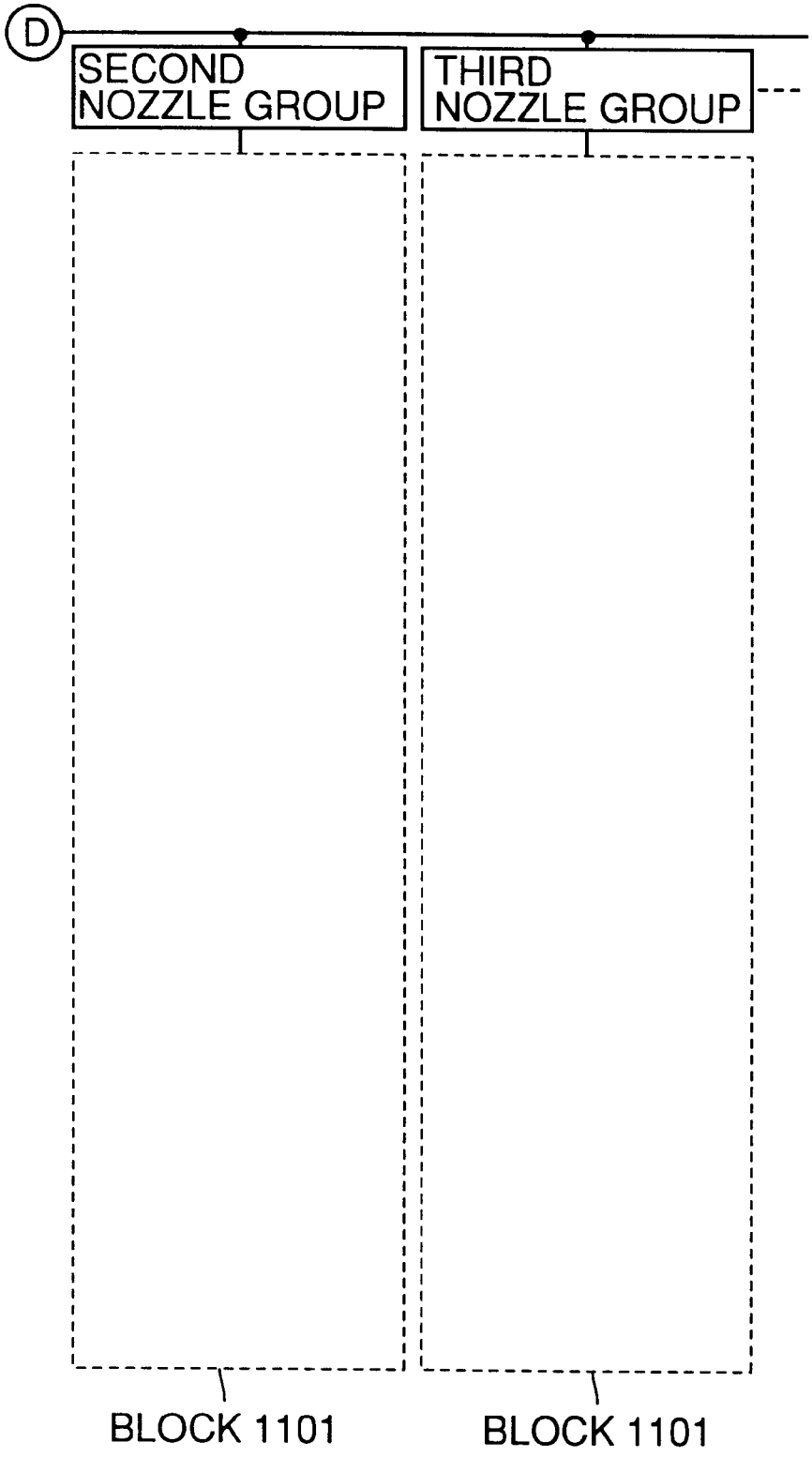

Referring to FIGS. 19A and 19B, the flow of ink purge control will be described. In the ink purge control, the process of block 1101 is repeated for respective ones of prescribed number of nozzle groups, starting from the first nozzle group.

CPU 241 determines whether the ink type is "A" or not in the first nozzle group (S1120). If the ink type is not "A" (NO in S1120), CPU 241 determines whether the ink type is "B" (S1140). In this manner, the ink type of the first nozzle group is determined. If the ink type is "A" (YES in S1120), the number of ink emission of the ink type "A" is determined based on the temperature and the prescribed number of lines, and it is preset in an area A (hereinafter referred to as counter 1A) of channel 1 of counter 1 (counter 1-1) (S1121). Whether there is a dot or dots to be printed is determined (S1122). When there is a dot or dots to be printed (YES in S1122), the number of dots to be printed is decremented from counter 1A, and the data is printed (S1123). When there is not any dot to be printed (NO in S1122) or when the process of S1123 is completed, whether printing of data corresponding to one line is completed or not is determined (S1124).

If printing of data corresponding to one line is not completed (NO in S1124), the flow returns to S1122, and the above described process is repeated until printing of data corresponding to one line is completed. If printing of data corresponding to one line has been completed (YES in S1124), whether printing of data of the prescribed number of lines has been completed or not is determined (S1125).

If printing of data corresponding to the prescribed number of lines has been completed (YES in S1125), the value of counter 1A is divided by the prescribed number of lines, and the result is set in counter 1B (area B of counter 1-1) and counter 1C (area C of counter 1-1) (S1126). If it is determined that printing of data for the prescribed number of lines has not yet been completed (NO in S1125), the value of counter IC is set in counter 1B (S1127). After the completion of the process of S1127 or S1126, whether the value of counter 1B is 0 or not is determined (S1128).

If the value of counter 1B is not 0 (NO in S1128), it means that ink emission has not yet been performed for the number of times set in counter 1B, and therefore ink is emitted from the nozzle once at the position opposing to ink receiving equipment 9 (S1129). The value of counter 1B is decremented by 1 (S1130). The flow returns to S1128, and the above described process is repeated until the value of counter 1B reaches 0. If the value of counter 1B is 0 (YES in S1128), it means that ink emission has been performed for the number of times set in counter 1B, and therefore the process is completed. Similar ink purge. control is performed successively on each channel of the first nozzle group.

The purge ink dot number is set by the unit of a plurality of lines. Therefore, the number of dots for printing for each row is made uniform. Further, ink is emitted at the position opposing to the ink receiving equipment 9 divided over a plurality of lines. Therefore, as compared with ink emission for every line, the number of purge ink dots can be made smaller.

Fifth Embodiment

A main portion of the printer for textile printing in accordance with a fifth embodiment is similar to the main portion of the printer for textile printing in accordance with the first embodiment. Therefore, description thereof is not repeated.

Figure 20:
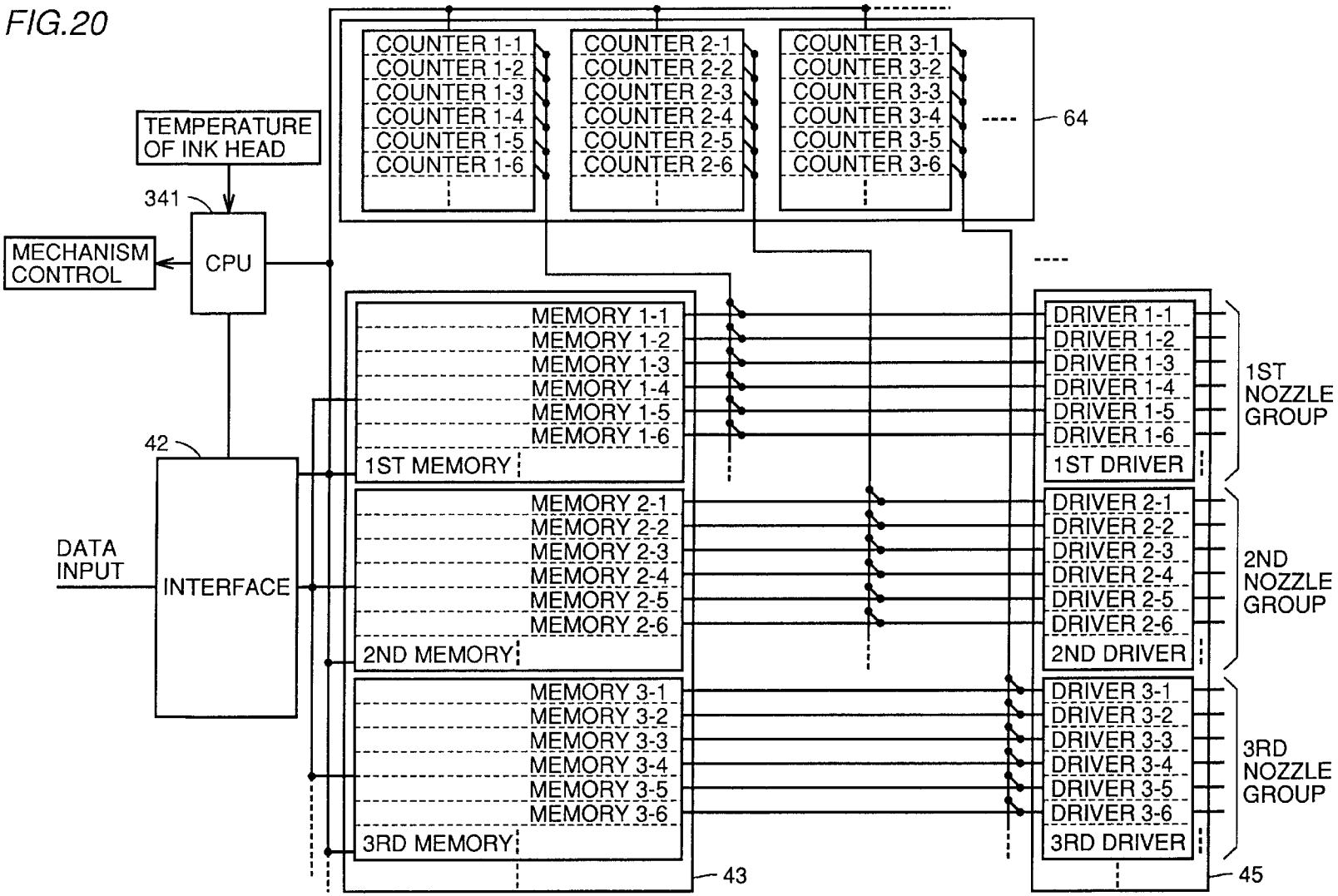
FIG. 20 is a block diagram showing a structure of a control unit of a printer for textile printing in accordance with a fifth embodiment.

Referring to FIG. 20, the control unit of the printer for textile printing in accordance with the present invention includes a CPU 341 for overall control, an interface 42 for receiving external print data, a memory group 43 for storing received print data for each nozzle 12, a counter group 64 for storing the number of ink emission set for each ink, and a driver group 45 for controlling ink emission in accordance with the print data stored in the memory group 43 and the number of ink emission stored in the counter group 64. The temperature of the print head is applied from a thermometer, not shown, to CPU 341. CPU 341 outputs an instruction for controlling printer mechanism.

CPU 341 presets purge ink dot number corresponding to each ink at each counter of counter group 64, in accordance with purge number designating information stored in the print data. When the counter value is not 0 at the completion of printing data corresponding to one line, the head emits ink until the counter value reaches 0, at the position opposing to ink receiving equipment 9.

Figure 21A:
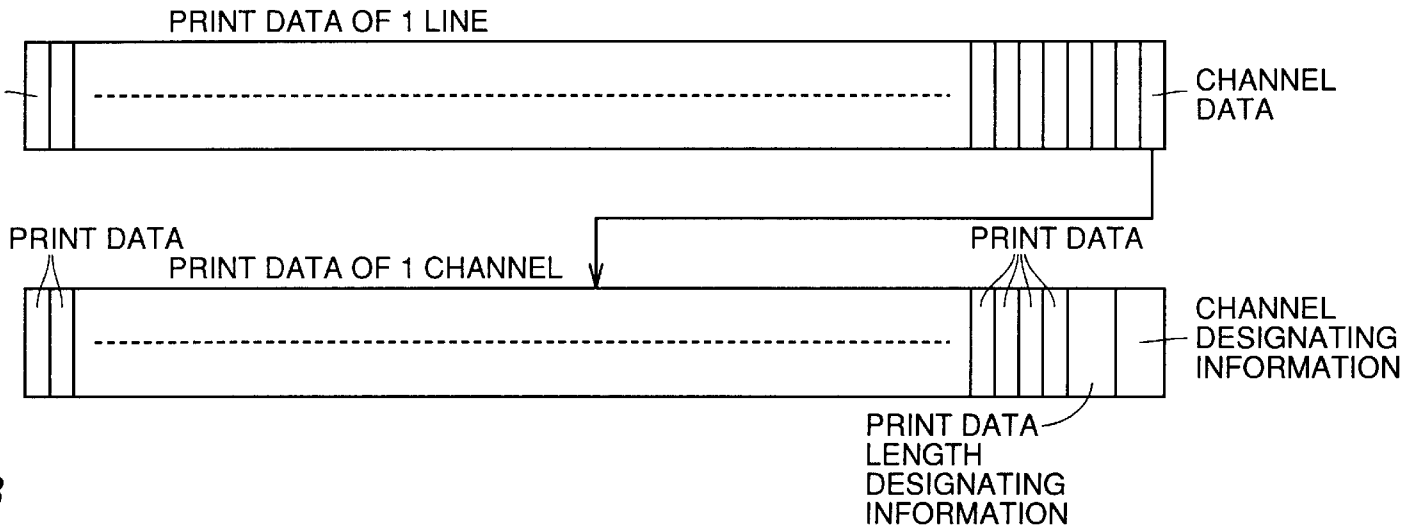
FIG.21A PRIOR ART
FIG. 21A is an illustration of conventional data for printing.
Figure 21B:
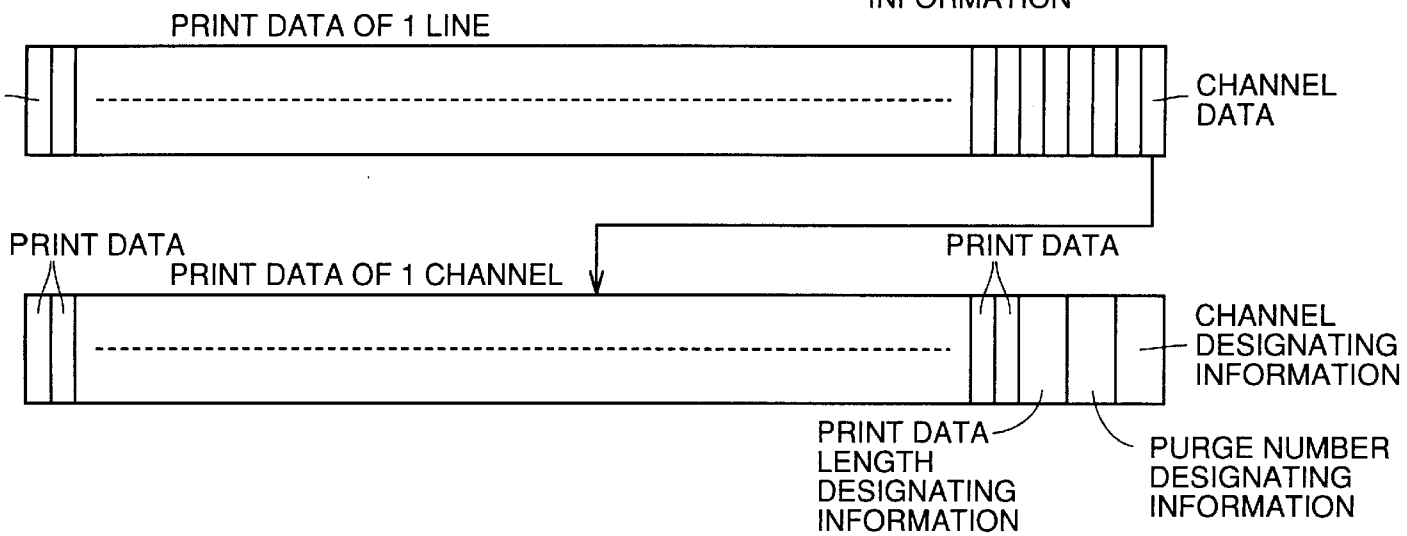
FIG.21B PRIOR ART
FIG. 21B is an illustration of data for printing in accordance with the fifth embodiment.

Referring to FIG. 21A, conventionally, the print data consists of a plurality of channel data. Each channel data includes channel designating information, print data length designating information and print data. Referring to FIG. 21B, in the print data of the present embodiment, which consist of the plurality of channel data as in the prior art, each channel data includes channel designating information, purge number designating information, print data length designating information and print data. The purge number designating information is read by CPU 341 and preset in counter 64, so that purge control of the head is performed.

Figure 22A:
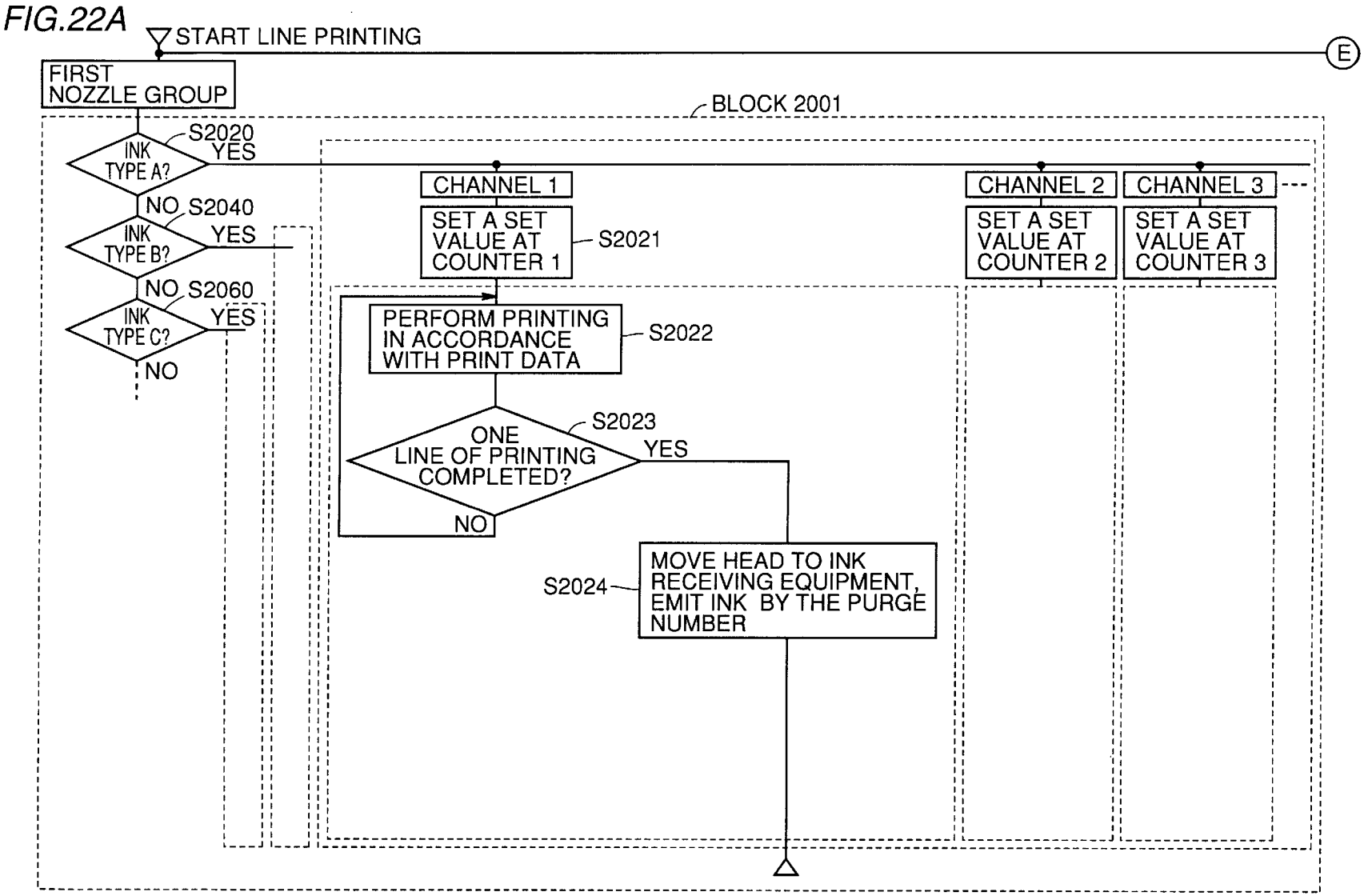
FIGS. 22A and 22B are flow charts of ink purge control in accordance with the fifth embodiment.
Figure 22B:
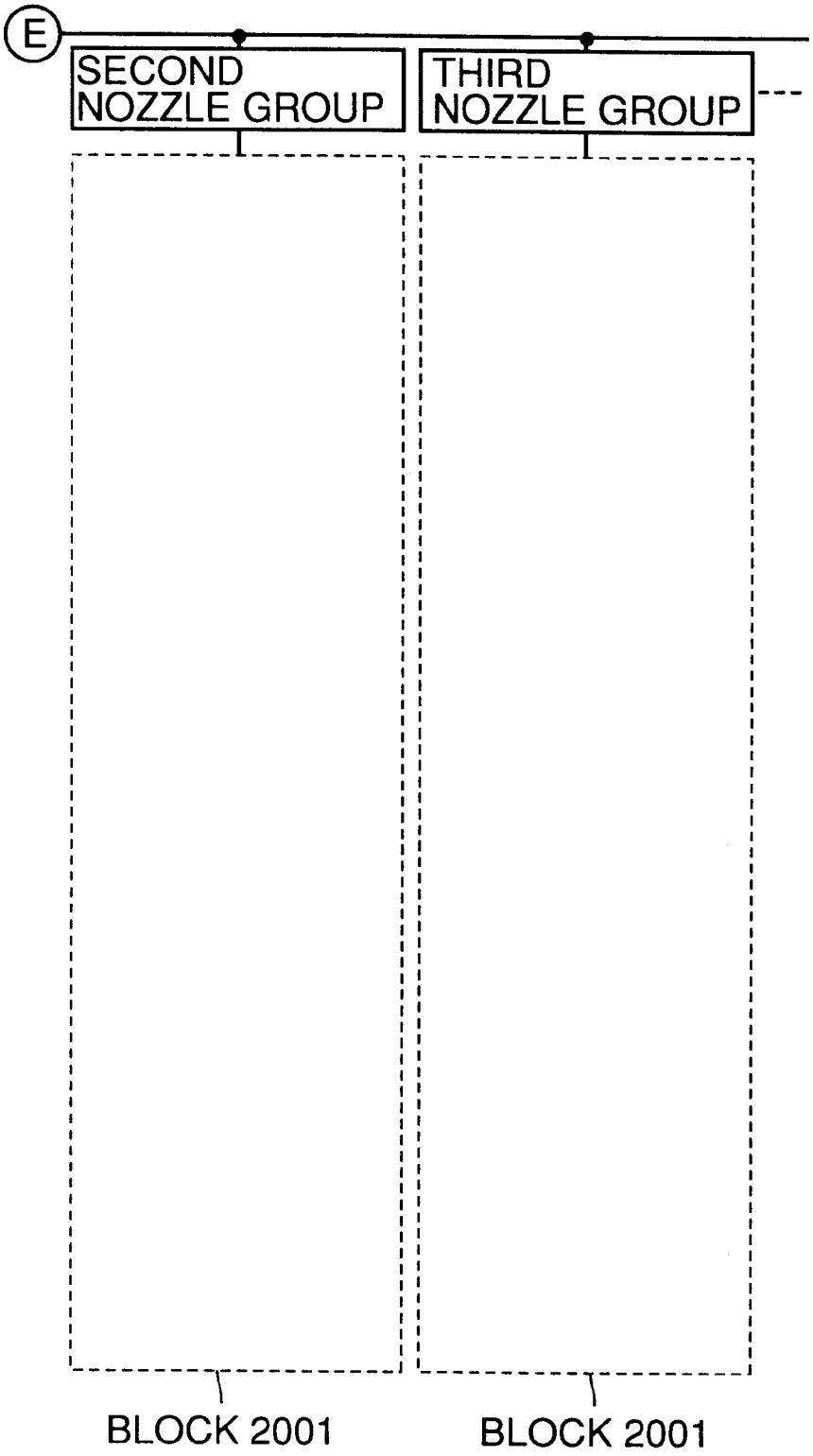

Referring to FIGS. 22A and 22B, the flow of ink purge control will be described. In the ink purge control, the process of block 2001 is repeated for respective ones of a prescribed number of nozzle groups, starting from the first nozzle group.

CPU 341 determines whether the ink type is "A" in the first nozzle group (S2020). If the ink type is not "A" (NO in S2020), CPU 341 determines whether the ink type is "B" (S2040). In this manner, ink type of the first nozzle group is determined. If the ink type is "A" (YES in S2020), CPU 341 reads the purge number designating information from the channel data, and sets the purge ink dot number at counter 1 (S2021).

Printing is performed in accordance with the print data (S2022). Whether printing of one line is completed or not is determined (S2023). If printing of one line has not yet been completed (NO in S2023), the flow returns to S2022, and the process of S2022 is repeated until printing of one line is completed. If processing of one line has been completed (YES in S2023), CPU 341 moves the head to the position opposing to ink receiving equipment 9, and the head emits to the ink receiving equipment 9 ink corresponding to the purge ink dot number set in counter 1 (S2024).

In this manner, as the purge ink dot number is recorded as information in the print data, it is not necessary for the printer to calculate the purge ink dot number during printing.

The number of actual emission may be calculated by CPU 341 from the purge number designating information, based on the information from temperature detector as in the third embodiment. The purge number designating information may be set for a prescribed number of lines, and ink emission may be made uniform for the prescribed number of lines, as in the fourth embodiment.

Sixth Embodiment

A main portion of the printer for textile printing in accordance with a sixth embodiment is similar to the main portion of the printer for textile printing in accordance with the first embodiment. Therefore, description thereof is not repeated.

Figure 23:
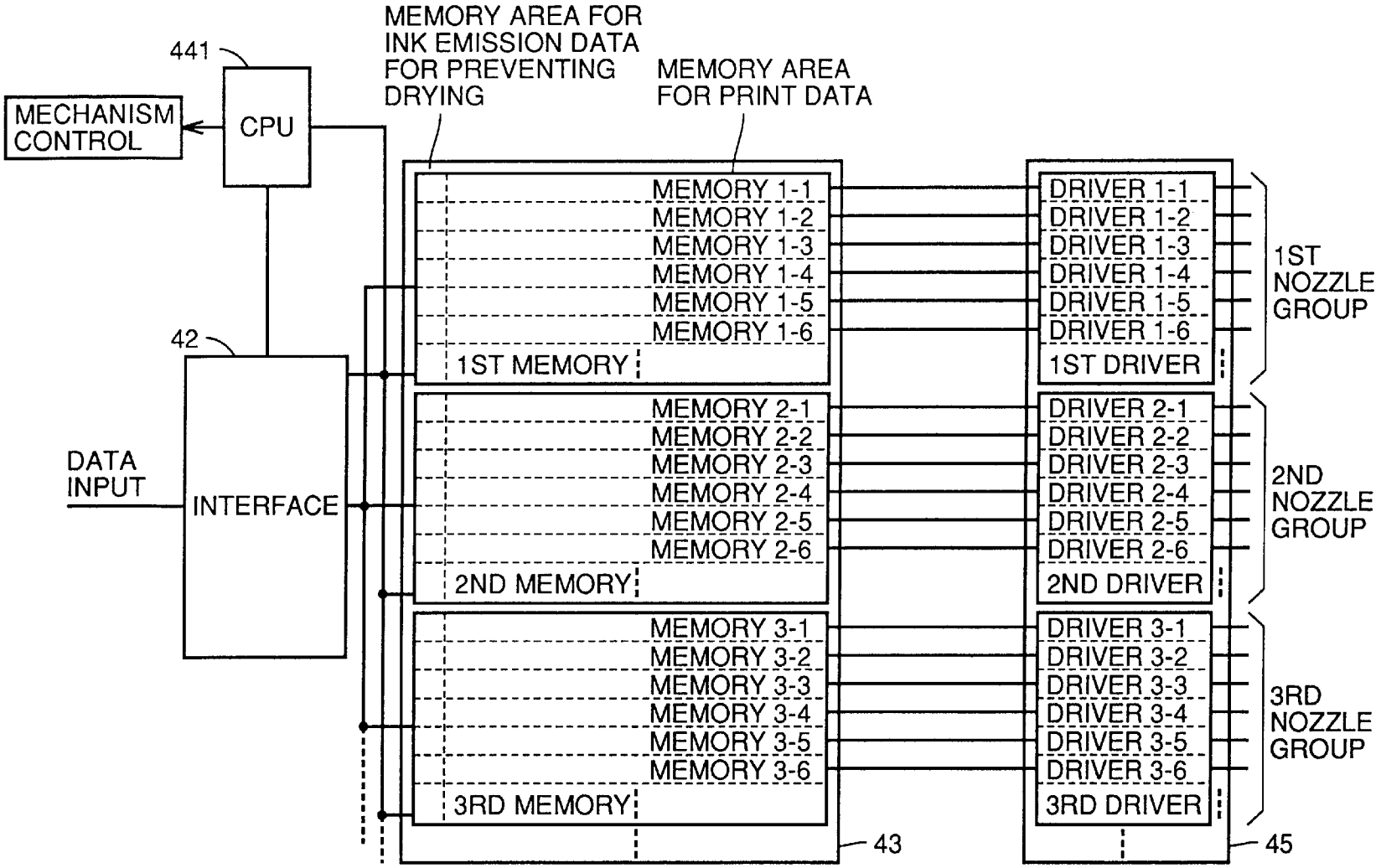
FIG. 23 is a block diagram showing a structure of a control unit of a printer for textile printing in accordance with a sixth embodiment.

Referring to FIG. 23, the control unit of the printer for textile printing in accordance with the sixth embodiment includes a CPU 441 for overall control, an interface 42 for receiving external print data, a memory group 43 for storing received print data for each nozzle 12, and a driver group 45 for controlling ink emission in accordance with the print data stored in memory group 43. CPU 441 outputs an instruction for controlling printer mechanism.

Figure 24:
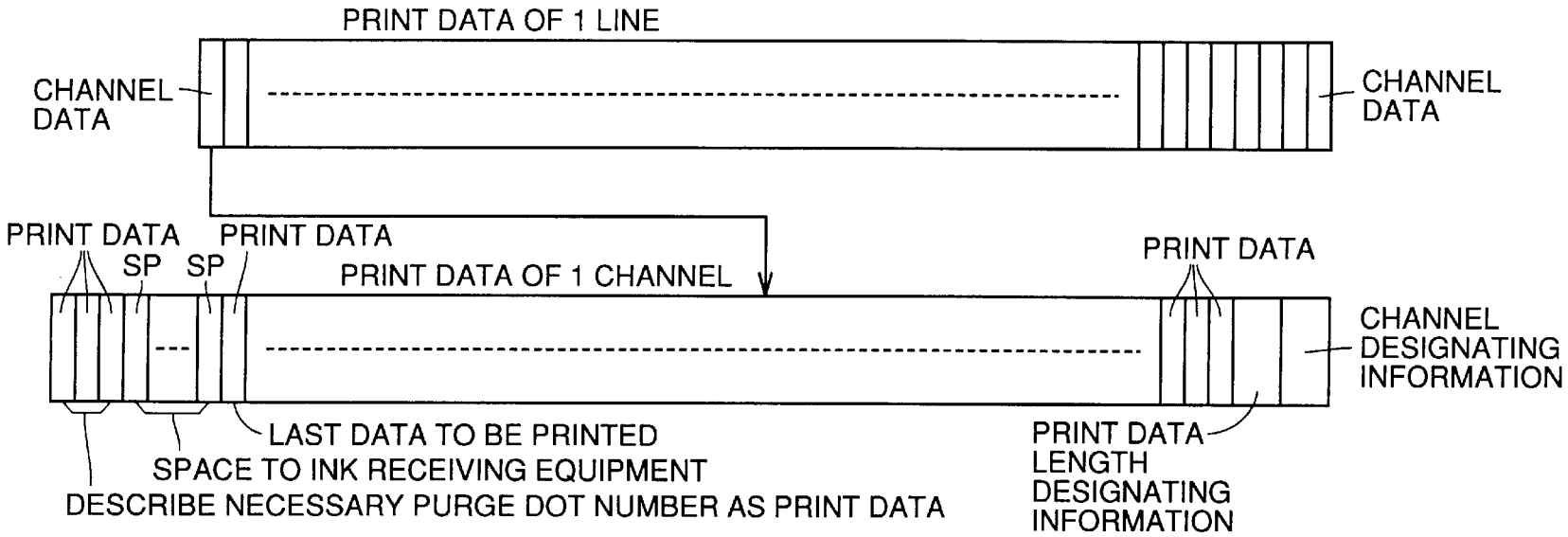
FIG. 24 is an illustration of data for printing in accordance with the sixth embodiment.

Referring to FIG. 24, of the print data corresponding to one line, the last channel consists of channel designation information, print data length designating information, print data, space information and print data. Following the actually required data for printing, there is provided the space information, based on which the head is fed to the position opposing to the ink receiving equipment 9. Ink emission takes place based on the print data following the space information. The print data is set in advance based on the print data preceding the space information, so that ink emission is performed for a prescribed number of times.

Figure 25A:
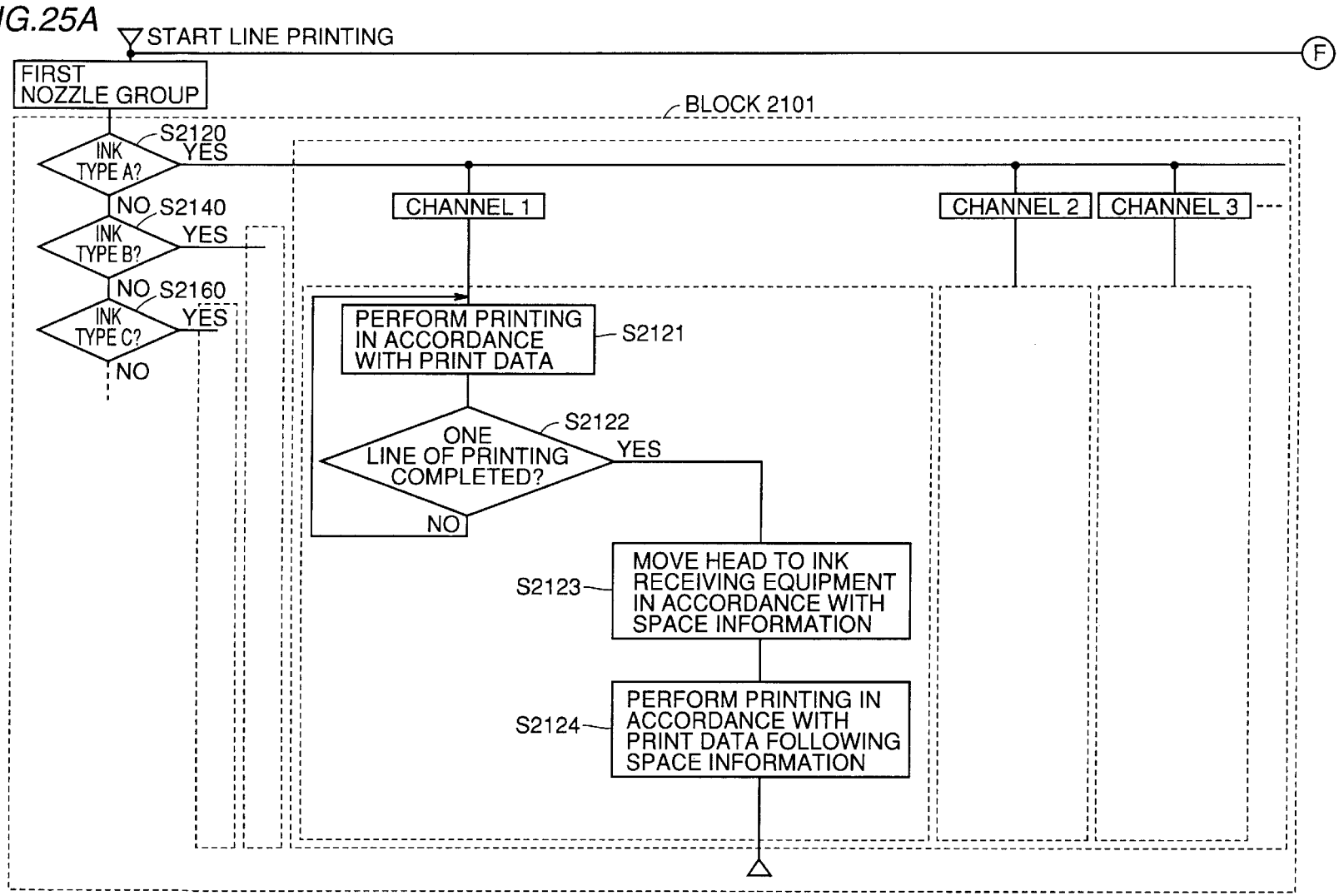
FIGS. 25A and 25B are flow charts of ink purge control in accordance with the sixth embodiment.
Figure 25B:
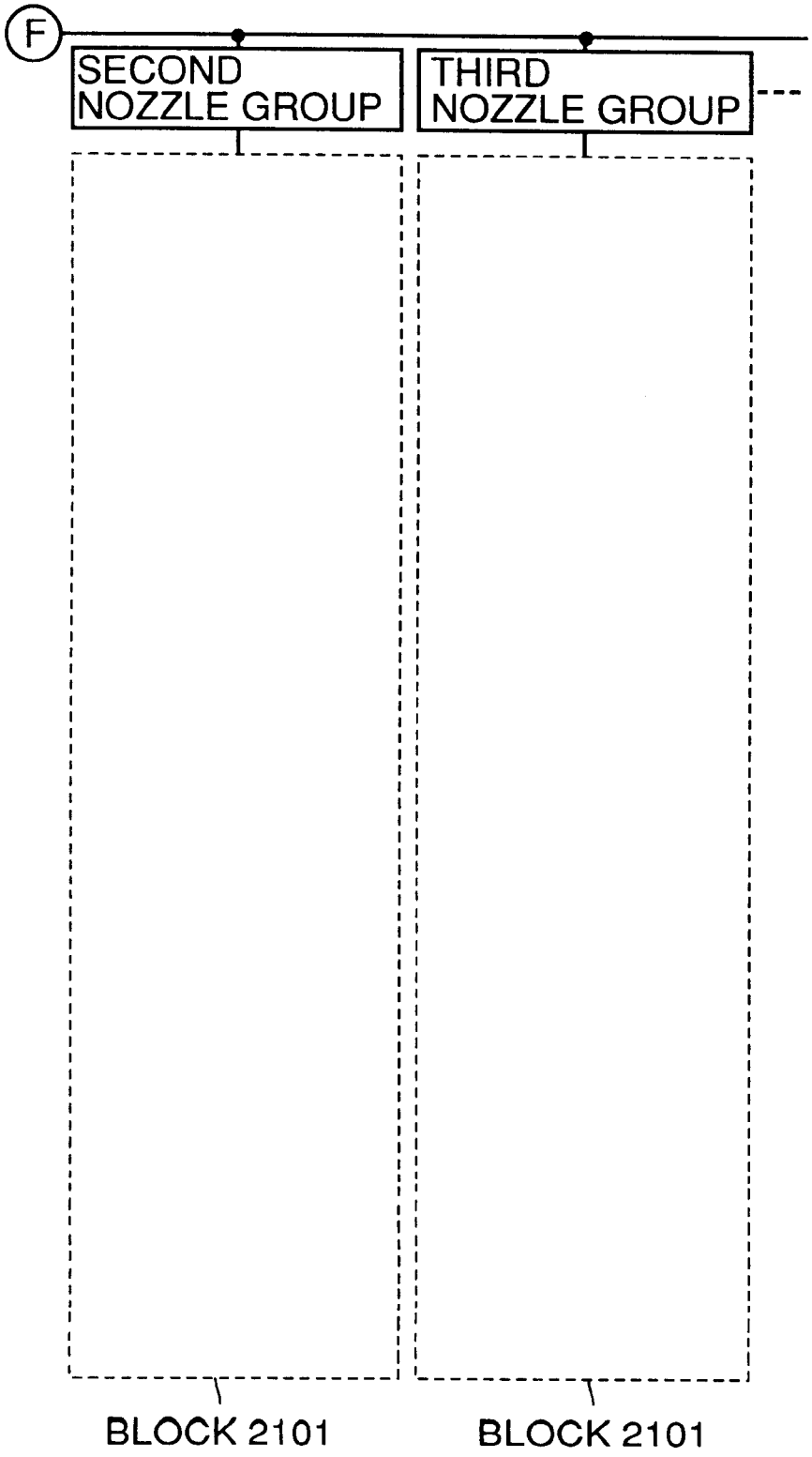

Referring to FIGS. 25A and 25B, the flow of ink purge control will be described. In the ink purge control, the process of block 2101 is repeated for respective ones of a prescribed number of nozzle groups, starting from the first nozzle group.

CPU 441 determines whether the ink type is "A" or not in the first nozzle group (S2120). If the ink type is not "A" (NO in S2120), CPU 441 determines whether the ink type is "B" (S2140). In this manner, the ink type of the first nozzle group is determined. If the ink type is "A" (YES in S2120), printing is performed based on the print data (S2121). Whether printing of one line is completed or not is determined (S2122). If printing of one line has not yet been completed (NO in S2122), the flow returns to S2121, and the process of S2121 is repeated until printing of one line is completed. If processing of one line has been completed (YES in S2122), head is fed to the position opposing to ink receiving equipment 9, based on the space information included in the last channel data of the print data for the one line (S2123). Based on the print data stored following the space information, the head emits to the ink receiving equipment 9 ink corresponding to the prescribed purge ink dot number, at the position opposing to ink receiving equipment 9 (S2124).

In this manner, by setting the print data to perform printing onto the ink receiving equipment 9 set outside the printing area, it is possible for the printer to emit ink in the form of purge ink dots to ink receiving equipment 9, without any special calculation or control.

The print data to be printed onto ink receiving equipment 9 may be calculated and determined by CPU 441 based on the information from the temperature detector, as in the third embodiment.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A recording apparatus, comprising:

recording material emitting means for emitting a plurality of different types of recording materials independently while performing reciprocating operation;

recording material receiving means provided outside a recording area for receiving said recording materials emitted from said recording material emitting means during the reciprocating operation;

recording material emission amount setting means for setting, for each one of said recording materials, an emission amount of the recording material emitted to said recording material receiving means; and control means for controlling said recording material emission means, so that each of said recording materials are periodically emitted by said emission amount to said recording material receiving means.

2. The recording apparatus according to claim 1, wherein:

said control means includes means for controlling said recording material emitting means, so that said recording material emitting means emits at every one reciprocating operation, said recording materials each of said emission amount to said recording material receiving means.

3. The recording apparatus according to claim 1, wherein said recording material emission amount setting means includes means for setting for each said recording material, an emission amount stored in print data as said emission amount of the recording material emitted to said recording material receiving means.

4. The recording apparatus according to claim 1, wherein:

said recording material receiving means includes first means provided outside said recording area for receiving said recording materials emitted from said recording material emitting means, and detecting means for detecting whether said recording materials received by said first means reach a prescribed amount.

5. The recording apparatus according to claim 4, wherein:

said control means include means for controlling said recording material emitting means such that said recording materials are periodically emitted each by said emission amount to said first means, and means responsive to an output from said detecting means, for actuating an alarm when said recording materials received by said first means reaches said prescribed amount, and for stopping operation of said recording material emitting means after said recording materials emitting means emits for a prescribed number of times said recording materials.

6. The recording apparatus according to claim 4, wherein said control means includes means for controlling said recording materials are emitting means such that said recording materials are periodically emitted each by said emission amount to said first means, and means responsive to an output from said detecting means, for giving an alarm when said recording materials received by said first means reach said prescribed amount, and stopping operation of said recording material emitting means after said recording materials emitting means emitted for a prescribed number of times said recording materials.

7. The recording apparatus according to claim 4, wherein:

said detecting means includes first detecting means for detecting whether said recording materials received by said first means reached a first prescribed amount, and second detecting means for detecting whether said recording materials received by said first means reached a second prescribed amount larger than said first prescribed amount; and said control means includes means for controlling said recording material emitting means such that said recording materials are periodically emitted by said emission amount determined for each said recording material to said first means, and means responsive to an output from said first detecting means for actuating an alarm, and means for stopping operation of said recording material emitting means responsive to an output from said second detecting means.

8. The recording apparatus according to claim 1, wherein the recording material receiving means is a tank having an opening adjacent to the recording material emitting means, so that ink can be received in the tank.

9. The recording apparatus according to claim 1, wherein:

said recording material emission amount setting means includes means for setting, for each one of said recording materials, an emission number of the recording material emitted to said recording material receiving means; and said control means includes means for controlling said recording material emission means, so that each of said recording materials are periodically emitted by said emission amount to said recording material receiving means.

10. A recording apparatus, comprising:

recording material emitting means for emitting a plurality of different types of recording material independently while the recording material emitting means performs a reciprocating operation;

recording material receiving means provided outside a recording area for receiving said recording materials emitted from said recording material emitting means during the reciprocating operation;

prescribed emission amount setting means for setting prescribed amount of emission determined for each said recording materials;

measuring means for measuring an emitted amount of said recording materials for each of said recording materials emitted from said recording material emitting means to the recording area; and control means for controlling said recording material emitting means such that said recording materials are periodically emitted in said amount determined for each recording material, to said recording material receiving means, in accordance with said prescribed emission amount and said emitted amount.

11. The recording apparatus according to claim 10, wherein:

said control means includes means for controlling said recording material emitting means for periodically emitting a decreasing amount of each said recording material, to said recording material receiving means.

12. The recording apparatus according to claim 11, further comprising means for measuring temperature of said recording material emitting means, wherein said prescribed emission amount setting means includes means for setting said prescribed emission amount determined in accordance with said temperature of said recording material emitting means for each said recording material.

13. The recording apparatus according to claim 10, further comprising means for measuring temperature of said recording material emitting means, wherein said prescribed emission amount setting means includes means for setting said prescribed emission amount determined in accordance with said temperature of said recording material emitting means for each said recording material.

14. The recording apparatus according to claim 10, wherein said control means includes means for controlling said recording material emitting means such that said recording materials in the amount determined for each recording material are emitted at every one reciprocating operation by said recording material emitting means, in accordance with said prescribed emission amount and said emitted amount.

15. The recording apparatus according to claim 10, wherein said prescribed emission amount setting means includes means for setting an emission amount stored in the print data as said prescribed emission amount, for each of said recording materials.

16. The recording apparatus according to claim 10, wherein said recording material receiving means includes first means provided outside said recording area for receiving said recording materials emitted from said recording material emitting means, and detecting means for detecting whether said recording materials received by said first means reached a prescribed amount.

17. The recording apparatus according to claim 16, wherein said control means includes means for controlling said recording material emitting means such that said recording materials are periodically emitted in the amount determined for each said recording material to said first means, in accordance with said prescribed emission amount and said emitted amount, and means responsive to an output from said detecting means for giving an alarm when said recording materials received by said first means reaches said prescribed amount, and for stopping operation of said recording material emitting means after said recording material emitting means performed a prescribed number of reciprocating operation and emitted said recording materials.

18. The recording apparatus according to claim 16, wherein said control means includes means for controlling said recording material emitting means such that said recording materials are periodically emitted by the amount determined for each said recording material to said first means, in accordance with said prescribed emission amount and said emitted amount, and means responsive to an output from said detecting means for giving an alarm when said recording materials received by said first means reaches said prescribed amount, and for stopping operation of said recording material emitting means after said recording material emitting means emitted said recording materials for a prescribed time period.

19. The recording apparatus according to claim 16, wherein:

said detecting means includes first detecting means for detecting whether said recording materials received by said first means reached a first prescribed amount having a first value, and second detecting means for detecting whether said recording materials received by said first means reached a second prescribed amount having a second value which is larger than said first prescribed amount having a first value; and said control means includes means for controlling said recording material emitting means such that said recording materials are periodically emitted by the amount determined for each recording material to said first means in accordance with said prescribed emission amount and said emitted amount, and means responsive to an output from said first detecting means for actuating an alarm, and responsive to an output from said second detecting means for stopping operation of said recording material emitting means.

20. The recording apparatus according to claim 10, wherein said prescribed emission amount setting means includes means for setting said emission amount determined for each said recording material, emitted by said recording material emitting means during a prescribed number of reciprocating operations.

21. The recording apparatus according to claim 10, wherein the recording material receiving means is a tank having an opening adjacent to the recording material emitting means, so that ink can be received in the tank.

22. A recording apparatus, comprising:

recording material emitting means for emitting a plurality of different types of recording materials independently while performing a reciprocating operation;

recording material receiving means provided outside a recording area for receiving from the plurality of nozzles said recording materials emitted from said recording material emitting means during the reciprocating operation;

recording material emission amount setting means for setting, for each of said recording materials, an amount of emission of the recording material emitted to said recording material receiving means; and control means for controlling said recording material emission means, so that each of said recording materials are periodically emitted by said emission amount to said recording material receiving means.

23. The recording apparatus according to claim 22, wherein the recording material receiving means includes a deflection plate set at an angle, so that ink mist is not generated.

24. The recording apparatus according to claim 23, wherein the angle is at most 30°.

25. The recording apparatus according to claim 22, further including a float and a first sensor for stopping the recording apparatus.

26. The recording apparatus according to claim 25, further including a second sensor.

27. The recording apparatus according to claim 22, further including a sponge member located in the recording material receiving means.

28. The recording apparatus according to claim 27, further including at least one spring for supporting the recording material receiving means.

29. The recording apparatus according to claim 22, wherein:

said recording material emission amount setting means includes means for setting, for each of said recording materials, a number of the recording materials emitted to said recording material receiving means; and said control means includes means for controlling said recording material emission means, so that each of said recording materials are periodically emitted by said emission amount to said recording material receiving means.

30. The recording apparatus according to claim 22, further including a sponge operatively associated with the emitting means.

31. A recording apparatus, comprising:

recording material emitting means for emitting a plurality of different types of recording materials independently while performing reciprocating operation;

recording material receiving means provided outside any printing area for receiving said recording materials emitted from said recording material emitting means during the reciprocating operation;

recording material emission amount setting means for setting, for each one of said recording materials, an emission amount of the recording material emitted to said recording material receiving means; and control means for controlling said recording material emission means, so that each of said recording materials are periodically emitted by said emission amount to said recording material receiving means.

32. The recording apparatus according to claim 31, wherein the recording material receiving means is for cleaning.

* * * * *